United States Patent [19]

Hirose et al.

[11] 4,138,258

[45] Feb. 6, 1979

[54] MULTI-LAYERED COLOR PHOTOGRAPHIC MATERIALS

[75] Inventors: Takeshi Hirose; Keisuke Shiba; Yukio Yokota; Kozo Inouye; Akio Okumura, all of Minami-ashigara, Japan

[73] Assignee: Fuji Photo Film Co., Ltd., Minami-ashigara, Japan

[21] Appl. No.: 805,070

[22] Filed: Jun. 9, 1977

Related U.S. Application Data

[63] Continuation of Ser. No. 608,801, Aug. 28, 1975, abandoned.

[30] Foreign Application Priority Data

Aug. 28, 1974 [JP] Japan ..... 49-98469

[51] Int. Cl.[2] ..... G03C 1/76; G03C 7/16; G03C 7/00; G03C 1/40

[52] U.S. Cl. ..... 96/74; 96/21; 96/54; 96/100 R

[58] Field of Search ..... 96/109, 74, 100, 21, 96/54, 66.3, 76 R

[56] References Cited

U.S. PATENT DOCUMENTS

| | | | |
|---|---|---|---|
| 2,865,751 | 12/1958 | Feniak et al. | 96/74 |
| 3,227,554 | 1/1966 | Barr et al. | 96/74 |
| 3,379,529 | 4/1968 | Porter et al. | 96/66.3 |
| 3,476,563 | 11/1969 | Loria | 96/100 |
| 3,516,831 | 6/1970 | Wolf et al. | 96/74 |
| 3,784,383 | 1/1974 | Iwama et al. | 96/100 |
| 3,785,828 | 1/1974 | Iwama et al. | 96/100 |
| 3,811,890 | 5/1974 | Ohta et al. | 96/74 |
| 3,811,892 | 5/1974 | Kagami et al. | 96/100 |
| 3,880,661 | 4/1975 | Lau et al. | 96/74 |
| 3,926,634 | 12/1975 | Sugizaki et al. | 96/100 |
| 3,933,501 | 1/1976 | Cameron et al. | 96/100 |
| 3,936,303 | 2/1976 | Shiba et al. | 96/74 |
| 3,941,601 | 3/1976 | Pelz et al. | 96/100 |
| 4,004,929 | 1/1977 | Orvis | 96/100 |

*Primary Examiner*—J. Travis Brown
*Assistant Examiner*—L. Falasco
*Attorney, Agent, or Firm*—Sughrue, Rothwell, Mion, Zinn and Macpeak

[57] ABSTRACT

A multilayer color photographic material comprising a support having thereon at least a blue-sensitive silver halide emulsion containing a yellow coupler, a green-sensitive silver halide emulsion layer containing a magenta coupler, and a red-sensitive silver halide emulsion layer containing a cyan coupler, with the red-sensitive silver halide emulsion layer or a gelatin interlayer adjacent the red-sensitive silver halide emulsion layer containing a non-diffusible colored compound which, on coupling reaction with the oxidation product of a primary aromatic amino developing agent at development, can release a diffusible dye capable of being removed from the photographic layer.

1 Claim, 2 Drawing Figures

MULTI-LAYERED COLOR PHOTOGRAPHIC MATERIALS

This is a Continuation, of application Ser. No. 608,801, filed Aug. 28, 1975, now abandoned.

BACKGROUND OF THE INVENTION

1. Field of the Invention

The present invention relates generally to color photography and more particularly it relates to a multilayer color photographic material having excellent color reproduction and sharpness.

2. Description of the Prior Art

A silver halide color photographic material based on the three primary color principle of the subtractive color process is fundamentally composed of a silver halide emulsion layer which is colored yellow by the action of blue light, a silver halide emulsion layer which is colored magenta by the action of green light, and a silver halide emulsion layer which is colored cyan by the action of red light.

It is well known that compounds forming dyes such as indophenols, indoanilines, indamines, azomethines, phenoxazines, phenazines, etc., by the coupling reaction with an oxidized primary aromatic amino developing agent, or the so-called couplers, are used as color formers for such color photographic materials.

In the above-described color photographic materials, acylacetamide derivatives or dibenzoylmethine derivatives are used as yellow-forming couplers, 5-pyrazolone derivatives, cyanoacetyl derivatives, indazolone derivatives, or pyrazolobenzoimidazole derivatives are used as magenta-forming couplers, and phenol derivatives or α-naphthol derivatives are used as cyan-forming couplers.

Ideally, in such color photographic materials based on the three primary color principle of the subtractive color process, the yellow dye image formed absorbs blue light only, the magenta dye image absorbs green light only, and the cyan dye image absorbs red light only. However, the dye images obtained in color photographic materials using these couplers do not always correspond to the ideal, that is, they have frequently side absorptions and absorb additionally light in other wave length regions.

A masking process using a so-called colored coupler for correcting the desired absorption of the dye images as described in, for example, *PSA Journal*, Vol. 13, 94(1947), is well-known.

The dye image obtained from a phenol derivative or a naphthol derivative used as a cyan-forming coupler has a main absorption in the red region of from about 600 nm to about 800 nm and also a side absorption in a blue wave length region of about 440 nm. Also, to correct the side absorption, use of a phenol type or α-naphthol type colored coupler in which the phenol or α-naphthol nucleus has been substituted with an azo group at the para-position to the hydroxyl group thereof is known. However, such a para-azo substituted phenol or α-naphthol type colored coupler usually has an insufficient color and, in particular, couplers of the above type having a sufficient color for correcting the side absorption in the green wave length region have not yet been discovered.

Also, the dye image obtained from a 5-pyrazolone derivative used as a magenta-forming coupler has a main absorption at a green wave length region of from about 450 nm to about 550 nm and side absorptions in the red wave length region and the blue wave length region. To correct the side absorptions, use of a 5-pyrazolone type colored coupler in which the 4-position of the 5-pyrazolone nucleus has been substituted with an azo group is also known. However, 4-azo substituted 5-pyrazolone type colored couplers usually have insufficient color and, in particular, couplers of the above type having a sufficient color for correcting the side absorption in a red wave length region have not yet been discovered.

Furthermore, conventional azo-substituted colored couplers as indicated above have a slow rate of reaction with an oxidized primary aromatic amino developing agent and hence provide an insufficient masking effect.

Still further, the color of conventional azo-substituted couplers changes as the pH of the processing solution is varied and hence do not provide a stable color.

U.S. Pat. No. 3,476,563 discloses a naphthol coupler having the structure (A) shown below

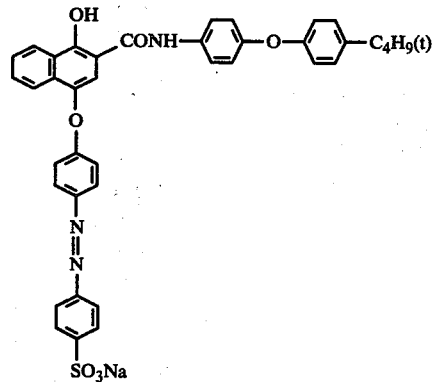

(A)

as a coupler for masking the blue wave length region of a cyan dye image.

Since a coupler of this type shows a high masking effect and less change in color due to changes in the pH of the processing solution, the above defects of azo-substituted type colored couplers can be overcome but the coupler has the difficulties that fog is formed in the photographic emulsion layers and the granularity of the silver halide emulsions is reduced.

SUMMARY OF THE INVENTION

A primary object of this invention is to provide a multilayer color photographic material containing in the photographic emulsion layers non-diffusible colored coupling compounds without the above defects.

Another object of this invention is to provide a multilayer color photographic material in which a photosensitive emulsion layer sensitive to a certain wave length region is not sensitive to the light of a wave length region to which another differently sensitized photosensitive emulsion layer is sensitive, in other words, to provide a multilayer color photographic material showing good color separation.

Still another object of this invention is to provide a multilayer color photographic material forming a color image having excellent sharpness.

A further object of this invention is to provide a multilayer color photographic material containing photographic emulsion layers having excellent granularity.

These and other objects of this invention will become apparent from the following description of the invention.

These objects of this invention are achieved with a color photographic material containing in a photographic emulsion layer a non-diffusible colored compound releasing, on coupling reaction with the oxidation product of a primary aromatic amino developing agent, a diffusible dye which can be removed from the photographic emulsion layer.

More particularly, according to the present invention, a multilayer color photographic material is provided comprising a support having coated thereon at least a blue-sensitive silver halide emulsion layer containing a yellow-forming coupler, a green-sensitive silver halide emulsion layer containing a magenta-forming coupler, and a red-sensitive silver halide emulsion layer containing a cyan-forming coupler, the red-sensitive silver halide emulsion layer or a gelatin interlayer adjacent the red-sensitive silver halide emulsion containing a non-diffusible colored compound releasing, on coupling reaction with the oxidation product of a primary aromatic amino developing agent, a diffusible dye which can be removed from the photographic emulsion layer.

DETAILED DESCRIPTION OF THE INVENTION

Figure 1:
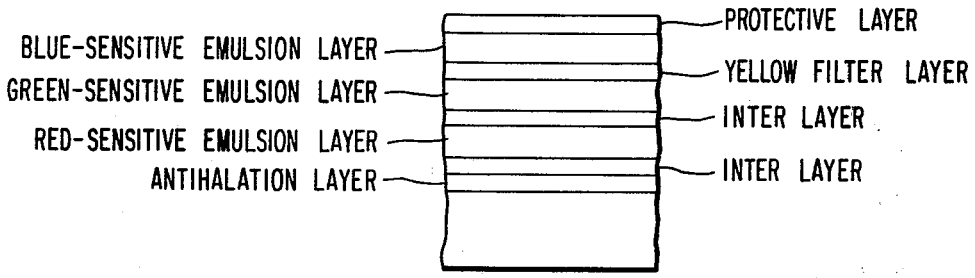
FIGS. 1 and 2 are schematic cross sectional views of the color photographic materials according to the present invention.

The term "a dye which can be removed from the photographic emulsion layer" as used in this specification means that the dye can be leached out by a processing solution from the photographic emulsion layer of the color photographic material.

The non-diffusible colored compounds each releasing by the coupling reaction with the oxidation product of a primary aromatic amino developing agent a diffusible dye which can be removed from the photographic emulsion layer used in this invention, can be represented by the following general formula (I):

$$[C] - L_o - [DD] \quad (I)$$

wherein [C] represents a diffusible coupling compound residue of which the coupling position is substituted with $-L_o-$ [DD]; [DD] represents a diffusible dye residue; and $-L_o-$ represents a group connecting the non-diffusible coupling compound residue [C] and the diffusible dye residue [DD]. Also, $-L_o-$ [DD] represents a group which can be released when the coupler [C] $-L_o-$ [DD] undergoes an oxidative coupling with a primary aromatic amino developing agent and removed from the photographic emulsion layer in a processing solution during the processing.

Specific and preferred examples of the non-diffusible coupling compound residue [C] are coupling compound residues having a nondiffusible group as described in U.S. Pat. Nos. 2,920,961; 2,875,057; 3,418,129; 3,658,544; 3,681,076; 3,062,653; 2,474,293; and 2,895,826, British Pat. No. 1,201,943; German Patent Application (OLS) No. 2,216,578, and U.S. Patent application Ser. No. 455,090, filled Mar. 27, 1974 (German Patent Application (0LS) No. 2,414,830) and U.S. Pat. No. 3,891,445 and these coupling compound residues are illustrated in U.S. Pat. Nos. 2,369,929; 2,474,293; 3,591,383; 3,458,315; 3,311,476; 3,419,390; 3,476,563; and 3,253,924, British Pat. No. 1,201,110, U.S. Pat. Nos. 2,600,783; 3,558,319; 3,468,666; 3,419,391; 3,311,476; 3,253,924; and 3,311,476, British Pat. No. 1,293,540, U.S. Patent application Ser. No. 445,032, filled Feb. 22, 1974 (German Patent Application (OLS) No. 2,408,665) and U.S. Patent application Ser. No. 462,842, filled Apr. 22, 1974 (German Patent Application (OLS) No. 2,418,959), U.S. Pat. Nos. 3,265,506; 2,728,658; 3,369,895; 3,582,322; 3,408,194; 3,415,652; and 3,253,924, British Pat. Nos. 1,285,411; 1,040,710; 1,302,398; and 1,204,680, German Patent Application (OLS) Nos. 1,956,281; 2,162,899; and 2,213,461, German Patent Application (OLS) No. 2,263,875, British Pat. No. 861,138; 914,145; and 1,109,963, Japanese Patent Publication No. 14033/1970, and U.S. Pat. No. 3,580,722 as well as in *Mitteilungs aus den Forshungs Laboratorien der Agfa Leverkusen;* Vol. 4, 352–365(1964). Also, other examples of these residues are the non-diffusible uncoloring coupling compounds as described in U.S. Pat. Nos. 3,632,345 and 3,227,554 and German Patent Application (OLS) No. 2,359,295.

The residues represented by [DD] are preferably known diffusible dye residues having dye moiety such as azo, azomethine, indoaniline, indophenol, anthraquinone, etc. Also, examples of the bonding group $-L_o-$ are preferably imido bonds, carbonyloxy bonds, sulfinyl bonds, sulfonyl bonds, sulfamido bonds, amido bonds, ether bonds, imino bonds, sulfonyloxy bonds, and thioether bonds as described in, for example, U.S. Pat. Nos. 3,458,315; 3,311,476; 3,622,328; 3,476,563; and 3,419,391, German Patent Application (OLS) No. 2,424,467, British Pat. No. 1,040,710, U.S. Pat. No. 3,415,652; German Patent Application (OLS) No. 2,213,461, and U.S. Pat. Nos. 3,730,722; 3,227,554; and 3,632,345.

Features of this invention are as follows. Namely, the non-diffusible colored coupling compound used for the color photographic material of this invention has an absorption at a certain desired absorption wave length region of a color imageforming dye in a visible region, the coupling compound is fixed in the photographic emulsion layer having added thereto the coupling compound without diffusing out and releases imagewise a diffusible dye by coupling with the oxidation product of a primary aromatic amino developing agent at color development, and the released diffusible dye is leached out from the photographic emulsion layer. The color photographic material of this invention shows greatly improved color separation and at the same time can achieve the above various objects of this invention.

In particular, the objects of this invention can be more advantageously achieved in a color photographic material containing in the photographic emulsion layer a non-diffusible colored cyan coupler having the general formula (II) or (III) described hereinafter. More particularly, in a preferred embodiment of this invention, the multilayer color photographic material comprises a support having coated thereon at least a blue-sensitive silver halide emulsion layer containing a yellow coupler, a green-sensitive silver halide emulsion layer containing a magenta coupler, and a red-sensitive silver halide emulsion layer containing a cyan coupler, the red-sensitive silver halide emulsion layer or a gelatin interlayer adjacent thereto containing a nondiffusible colored cyan coupler having the general formula (II) or (III) as shown below.

Furthermore, according to another preferred embodiment of this invention, a color image forming process is provided by subjecting, after imagewise exposure, a multilayer color photographic material having coated on a support at least a bluesensitive silver halide emulsion layer containing a yellow coupler forming a yellow dye by an oxidative coupling reaction with a primary aromatic amino developing agent, a green-sensitive silver halide emulsion layer containing a magenta coupler forming a magenta dye by the oxidative coupling reaction with the developing agent, and a red-sensitive silver halide emulsion layer containing a cyan coupler forming a cyan dye to a color development with a processing solution containing a primary aromatic amino developing agent, which comprises developing the color photographic material containing a non-diffusible colored cyan coupler having the general formula (II) or (III) in the color photographic material, the colored cyan coupler releasing a diffusible dye at the formation of a cyan dye by the oxidative coupling with the primary aromatic amino developing agent.

The colored cyan couplers described above have the general formula (II) or (III)

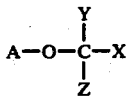

(II)

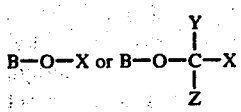

(III)

wherein X represents a group containing a chromophore; Y, and Z each represents a hydrogen atom or a photographically inert group, with at least one of X, Y, and Z having an acid group; A represents a 1-naphtholic cyan coupler residue of which the coupling position is substituted with

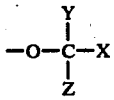

and B represents a phenolic cyan coupler in which the coupling position is substituted with

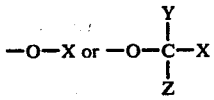

Furthermore, 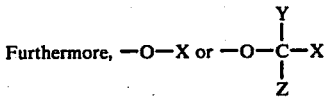

represents a residue which is released as a diffusible dye when the coupler represented by general formula (II) or (III) forms a cyan dye by the oxidative coupling with a primary aromatic amino developing agent in the development step and is leached out from the photographic emulsion layer containing it.

The colored cyan coupler represented by general formula (II) or (III) preferably contains at least one non-diffusible group having 8 to 32 carbon atoms in the molecule.

Examples of photographically inert groups for Y and Z in the colored cyan couplers represented by the general formula (II) or (III) are, for example, a halogen atom (such as fluorine, chlorine, bromine, iodine, etc.), a cyano group, a hydroxyl group, a nitro group, an alkyl group (such as a methyl group, a t-butyl group, an octyl group, a dodecyl group, a stearyl group, a benzyl group, a phenethyl group, an α-hydroxypropyl group, a 2,4-dichloroamyl group, a γ-cyanopropyl group, a β-methoxyethyl group, etc.), an aryl group (such as a phenyl group, a 2-chlorophenyl group, a 4-cyanophenyl group, a 3-nitrophenyl group, a 2,4,6-trichlorophenyl group, a 2,4-di-t-amylphenyl group, a naphthyl group, etc.), a heterocyclic group (such as a 2-thiazolyl group, a 2-benzothiazolyl group, a 2-benzoxazolyl group, a pyridyl group, etc.), an alkoxy group (such as a methoxy group, a butoxy group, a benzyloxy group, a stearyloxy group, etc.), an aryloxy group (such as a phenoxy group, a p-t-butylphenoxy group, a naphthoxy group, etc.), an alkylthio group (such as a methylthio group, a dodecylthio group, etc.), an arylthio group (such as a phenylthio group, etc.), an amino group (such as an amino group, a methylamino group, an N,N-ethylhexylamino group, an anilino group, etc.), a sulfamoyl group (such as an N-sulfamoyl group, an N,N-dihexylsulfamoyl group, an N-phenylsulfamoyl group, etc.), a carbamoyl group (such as a diethylcarbamoyl group, a t-butylcarbamoyl group, a dodecylcarbamoyl group, etc.), and an alkoxycarbonyl group (such as a methoxycarbonyl group, etc.).

The naphthyl group represented by A in the general formula (II) and phenyl group represented by B in the general formula (III) can be substituted with in addition to a hydroxyl group, a photographically inert substituent as defined for Y and Z.

Also, the above group containing a chromophore is a residue for coloring a coupler and can be specifically an azo dye residue represented by $$-[Ar_1]-N=N-[Ph_1],$$

$$-[Ar_1]-N=N-[Ar_2],$$
$$-[Ar_1]-N=N-[Het], \text{ etc.,}$$

in the above formulae, $-[Ar_1]$ represents an arylene group (such as a phenylene group, a naphthylene group, etc.), $-[Ph_1]$ represents a phenyl group having a water-soluble group or a hydrophilic group (with examples of water-soluble groups being, for example, $-SO_3M$ and $-COOM$ where M is a hydrogen atom or a cation (such as an alkali metal ion, an ammonium ion, etc.), and with examples of hydrophilic groups being, for example, a hydroxy group, a sulfamoyl group, an amido (e.g., an amido, a carbonamido, a sulfonamido, etc.) group, an alkoxycarbonamido group having 1 to 4 carbon atoms in the alkyl moiety thereof). Specific examples of phenyl groups are illustrated below

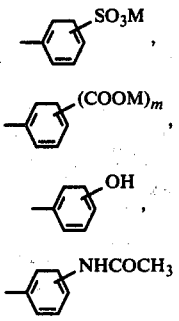

and

-continued

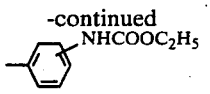

[$Ar_2$] represents a hydroxynaphthyl group having a water-soluble group or a hydrophilic group (with examples of water-soluble groups being, for example, —$SO_3M$ and —COOM where M is as described above, and with examples of the hydrophillic groups being, for example, a hydroxy group, a sulfamoyl group, an amido (e.g., an amido, a carbonamido, a sulfonamido, etc.) group, an alkoxycarbonamido group having 1 to 4 carbon atoms in the alkyl moiety thereof). Specific examples of hydroxynaphthyl groups are illustrated below.

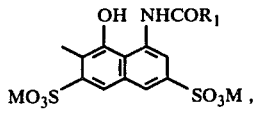

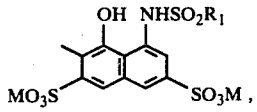

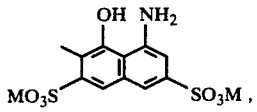

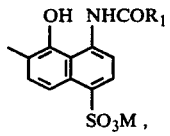

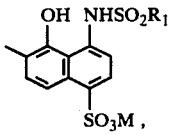

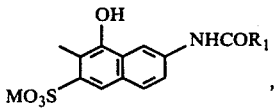

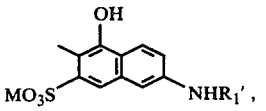

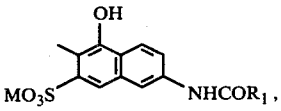

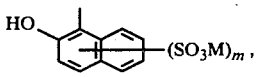

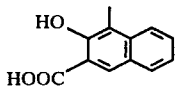

and

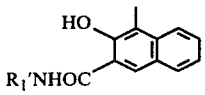

Also, in the above general formula, —[Het] represents an aromatic heterocyclic group and preferably an aromatic heterocyclic group containing a water-soluble group such as —$SO_3M$ and —$CO_2M$ where M is as described above. Specific examples of aromatic heterocyclic groups are those represented by the formula

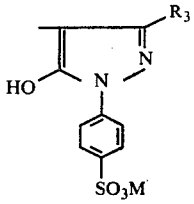

or

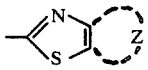

In the above formulae, Z represents a non-metallic atomic group forming a condensed aryl ring (such as a benzene ring, a naphthalene ring); M represents a hydrogen atom or a cation (such as an alkali metal ion, an ammonium ion, etc.); $R_1$ represents an alkyl group having 1 to 7 carbon atoms (such as a methyl, ethyl, tert-butyl, n-pentyl, chloromethyl, dichloromethyl, trifluoromethyl, perfluoropropyl, $\beta$-carboxyethyl, etc., group), a phenyl group (such as a phenyl, chlorophenyl, tolyl, methoxyphenyl, etc., group), a naphthyl group (such as a naphthyl etc. group), etc.; $R_1'$ represents an alkyl group, a phenyl group, an naphthyl group as defined for $R_1$ and a hydrogen atom; and $R_2$ represents an amino group (such as an N-methylamino,N,N-dimethylamino, N,N-diethylamino, pyrrolidino, piperidino, etc., group), an alkyl group having 1 to 5 carbon atoms (such as a methyl, ethyl, tert-butyl, chloromethyl, dichloromethyl, trifluoromethyl, perfluoropropyl, etc., group), an acylamino group (such as an acetamido, tert-butyramido, benzamido, pyrrolidon-1-yl, etc., group), a sulfonamido group (such as a methanesulfonamido, benzenesulfonamido, etc., group), a ureido group (such as a methylureido, cyclohexylureido, phenylureido, etc., group), an alkoxycarbonyl group (such as a methoxycarbonyl, butoxycarbonyl, etc., group), and a carboxyl group; and m is an integer of 1 to 2.

Other examples of residues containing a chromophore are an indoanilinic dye residue as illustrated by the formulae

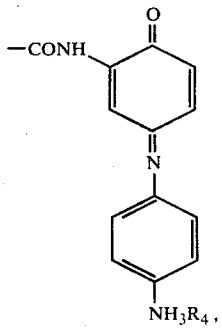

-continued

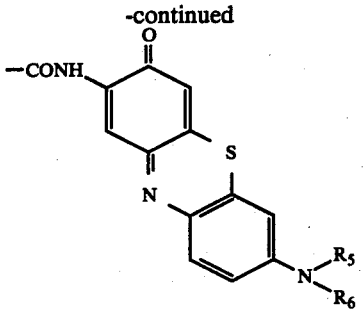

and

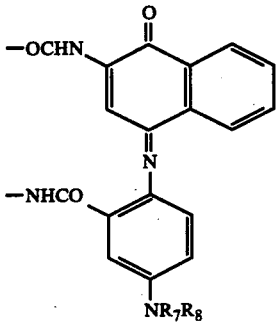

wherein $R_3$, $R_4$, $R_5$, $R_6$, $R_7$, and $R_8$ each represents an unsubstituted or substituted alkyl group having 1 to 5 carbon atoms such as a methyl, ethyl, β-hydroxyethyl, β-methansulfonamidoethyl, ethoxyethyl, sulfoethyl, carboxyethyl, methylsulfonylethyl, phenylsulfonylethyl, etc., group, and each may be the same or different; an indophenolic dye residue as illustrated by the formula

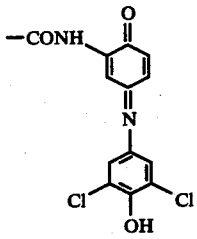

and the onium salts thereof; and
an anthraquinonic dye residue as illustrated by the formulae

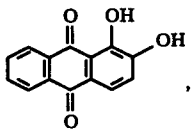

and

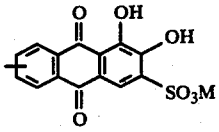

wherein M is as described above.

To render the couplers non-diffusible, a group having a hydrophobic residue having 8 to 32 carbon atoms is introduced into each molecule of the couplers. Such a residue is called a "ballast group". The ballast group can be bonded to the coupler directly or through an imino bond, an ether bond, a thioether bond, a carbonamido bond, a sulfonamido bond, a ureido bond, an ester bond, an imido bond, a carbamoyl bond, a sulfamoyl bond, etc.

Specific examples of suitable ballast groups are illustrated below.

(I) Alkyl groups and alkenyl groups:

For example, $-CH_2-CH-(C_2H_5)_2$, $-C_{12}H_{25}$, $-C_{16}H_{33}$, and $-C_{18}H_{35}$.

(II) Alkoxyalkyl groups:

For example, $-(CH_2)_3-O-(CH_2)_7CH_3$ and $$-(CH_2)_3OCH_2-\underset{\underset{C_2H_5}{|}}{CH}-(CH_2)_8-CH_3 .$$

as described in Japanese Patent Publication No. 27563/1964. (III) Alkylaryl groups: For example,

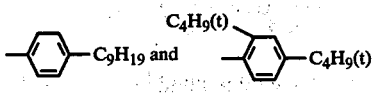

(IV) Alkylaryloxyalkyl groups:

For example,

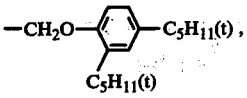

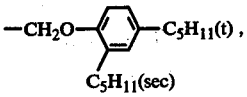

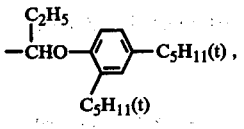

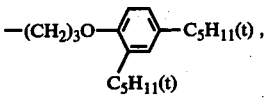

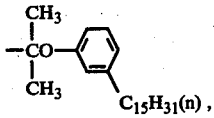

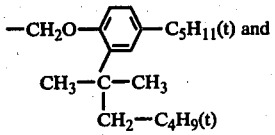

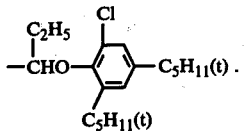

(V) Acylamidoalkyl groups:

For example,

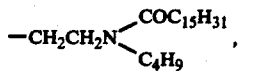

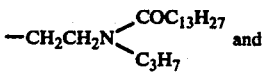

and

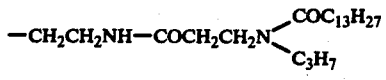

as described in U.S. Pat. Nos. 3,337,344 and 3,418,129.

(VI) Alkoxyaryl groups and aryloxyaryl groups:
For example,

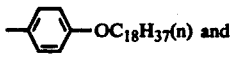

and

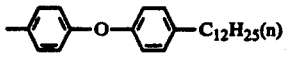

(VII) Residues each containing both an alkyl or alkenyl long-chain aliphatic group and a carboxyl or sulfo water-solubilizable group:
For instance,

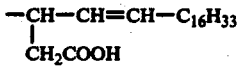

and

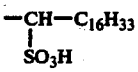

(VIII) Alkyl groups substituted with an ester group:
For example,

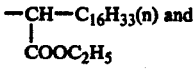

and

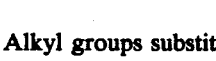

(IX) Alkyl groups substituted with an aryl group or a heterocyclic group:
For example,

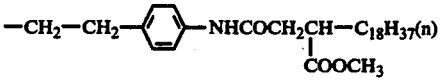

and

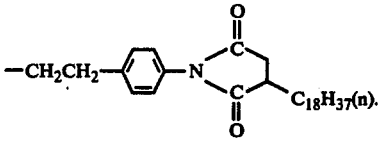

(X) Aryl groups substituted with an aryloxyalkoxycarbonyl group:
For example,

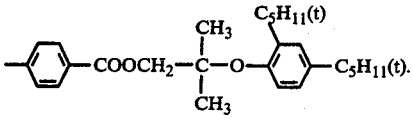

The colored cyan couplers of this invention represented by the general formula (II) or (III) have a main absorption in the wave length region of about 400 to 600 nm and when the cyan couplers form cyan dyes by the oxidative coupling reaction with a primary aromatic amino developing agent at color development, the moiety containing a chromophore having an absorption in the above described wave length region is released as a diffusible dye and is removed from the photographic emulsion layer during the course of development.

In this case, the group

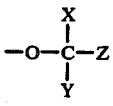

or

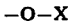

released from the colored cyan coupler of the general formula (II) or (III) by the coupling reaction with the oxidation product of a primary aromatic amino developing agent preferably is leached out in the processing solution from the color photographic material at development and for this purpose also at least one of X, Y, and Z preferably contains an acid group, namely a water-soluble group such as a sulfo group, a carboxyl group, etc.), and a hydrophilic group (such as a sulfoamido group, etc.), for promoting the diffusibility.

The colored couplers of the general formulae (II) and (III) used in the color photographic materials of this invention have the following features.

First of all, a p-azo substituted phenol or naphthol which is conventionally used as a colored coupler has less freedom from the standpoint of the selection of color and, in particular has insufficient green light absorption due to the structural restriction that the chromophore thereof is an azo group directly connected to the coupling position of the phenol or naphthol, while in the colored couplers of the general formula (II) or (III), the chromophore residue is disposed apart from the coupling position and hence the color of the dye image formed therefrom can be desirably selected by selecting the type of bonding.

Second, the colored couplers of the general formulae (II) and (III) have sufficient coupling activity and hence a sufficient masking effect can be obtained using these colored couplers.

Third, the colored couplers of the general formulae (II) and (III) exhibit much less change in color due to changes in pH and hence there are less restrictions on processing.

Also, the colored couplers of the general formulae (II) and (III) used in this invention neither form fog in photographic emulsion layers nor reduce the granularity of the photographic emulsions, in contrast to the above naphthol-type couplers having an aryloxy group at the para-position to the hydroxyl group thereof as represented by the general formula (A).

Preferred examples of the non-diffusible colored cyan couplers of this invention meeting the above features can be represented by following general formulae (IIa), (IIIa), (IIb) and (IIIb) as shown below.

That is, examples of the non-diffusible cyan coupler having a main absorption in the wave length region of about 500 to 600 nm are preferably the couplers represented by the following general formulae (IIa) and (IIIa):

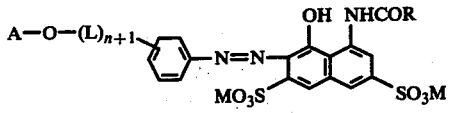
(IIa)

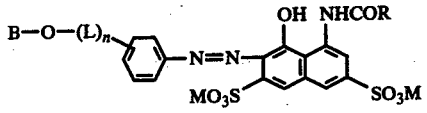
(IIIa)

wherein A and B have the same meaning as in the general formula (II) or (III); n is 0, 1, or 2; M represents a hydrogen atom or a monovalent cation; R represents an alkyl group having 1 to 7 carbon atoms (such as a methyl, ethyl, tert-butyl, n-pentyl, chloromethyl, dichloromethyl, trifluoromethyl, perfluoropropyl, β-carboxyethyl, etc., group), a phenyl group (such as a phenyl, chlorophenyl, tolyl, methoxyphenyl, etc., group), a naphthyl group (such as a naphtyl, etc., group); and L represents $-(CH_2)_p-$, $-(CH_2)_q-O-$ or $$-CH_2\underset{\underset{X'}{|}}{C}HCH_2O-,$$

wherein p is 0, 1, 2, 3 or 4; q is 1, 2, 3 or 4; and X' represents a hydroxyl group or a halogen atom such as a chlorine atom, a fluorine atom, etc..

Also, examples of the non-diffusible colored cyan couplers used in this invention having a main absorption in the wave length region of about 400 to 500 nm are preferably the couplers represented by the following general formulae (IIb) and (IIIb):

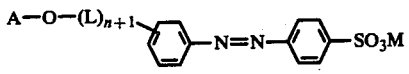
(IIb)

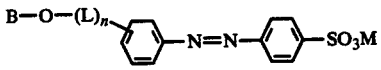
(IIIb)

wherein A and B have the same meaning as in the general formula (II) or (III); n is 0, 1, or 2; M represents a hydrogen atom or a monovalent cation; and L has the same meaning as in the general formula (IIa) or (IIIa).

Furthermore, particularly preferred examples of non-diffusible colored cyan couplers of general formulae (II) and (III) are shown by the following general formulae (IVa) to (IVk):

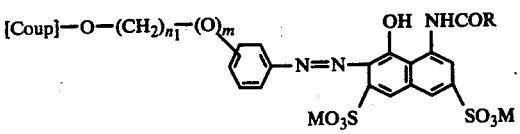
(IVa)

-continued

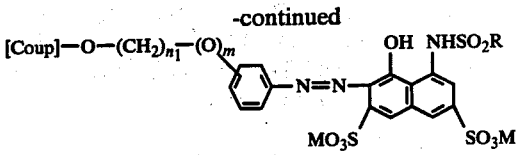
(IVb)

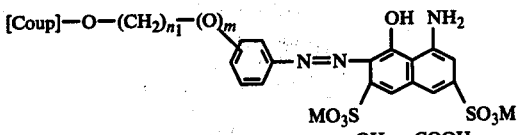
(IVc)

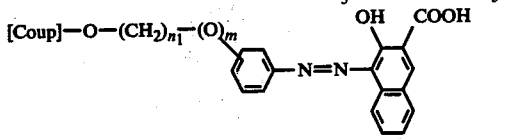
(IVd)

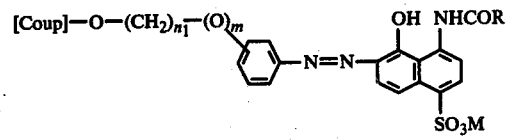
(IVe)

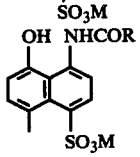
or

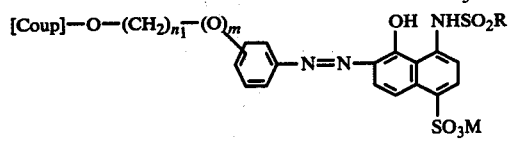
(IVf)

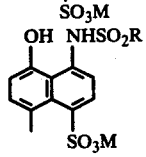
or

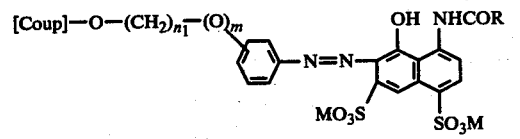
(IVg)

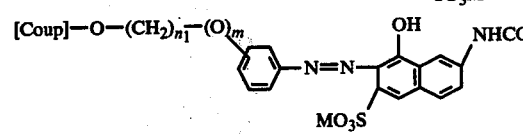
(IVh)

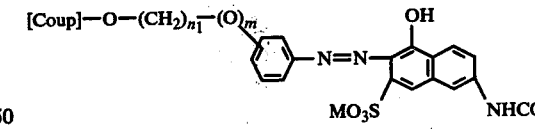
(IVi)

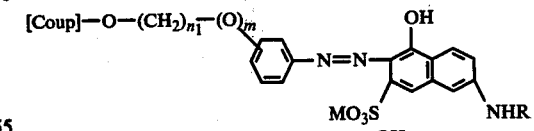
(IVj)

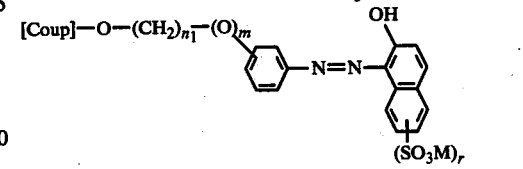
(IVk)

wherein M and R have the same meaning as in the general formula (IIa); $n_1$ is an integer of from 1 to 4; m is 0 or 1; r is 1 or 2; and [Coup] means A or B shown in the general formula (II) and (III).

Furthermore, the couplers represented by following general formulae (II-c), (III-c), (II-d), (III-d), (II-e), (III-e), (II-f), (III-f), (II-g), (III-g), (II-h), (III-h), (II-i), (III-i), (II-j), (III-j), (II-k), (III-k), (II-m), and (III-m) can be advantageously used as the non-diffusible colored cyan couplers in this invention:
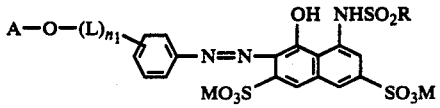
(II-c)
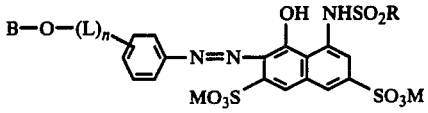
(III-c)
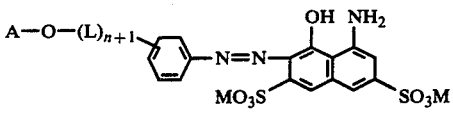
(II-d)
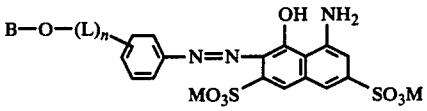
(III-d)
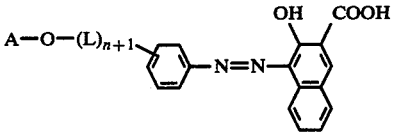
(II-e)
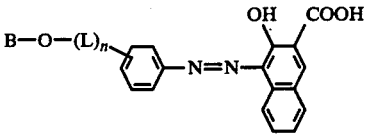
(III-e)
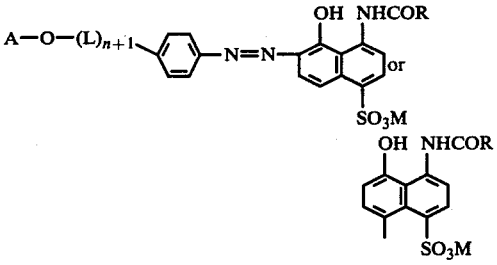
(II-f)
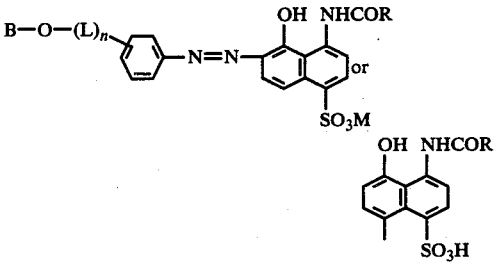
(III-f)
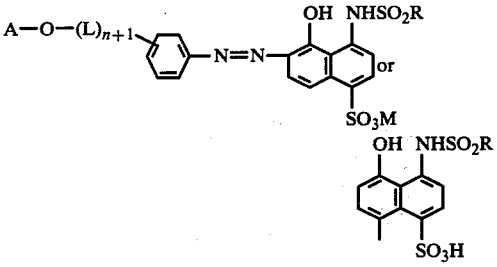
(II-g)
-continued
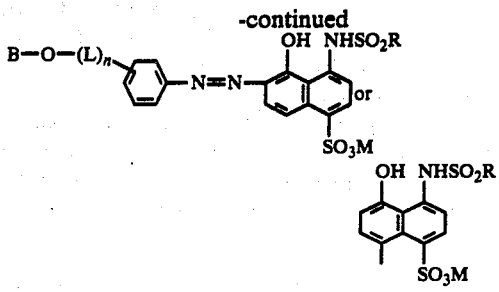
(III-g)
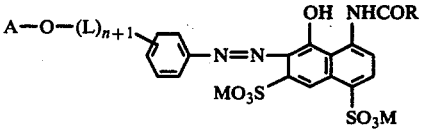
(II-h)
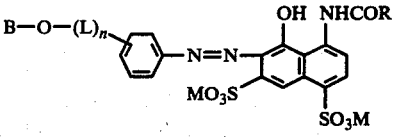
(III-h)
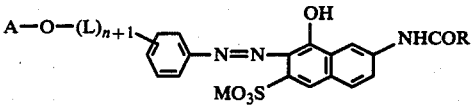
(II-i)
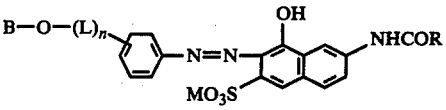
(III-i)
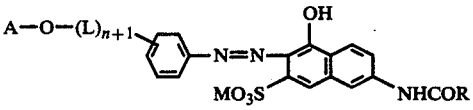
(II-j)
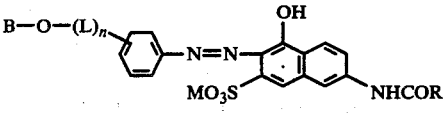
(III-j)
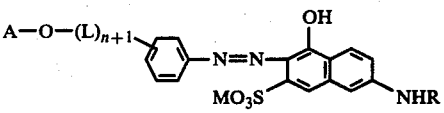
(II-k)
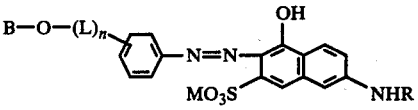
(III-k)
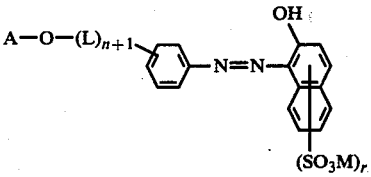
(II-m)
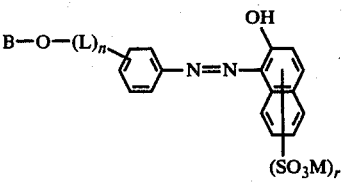
(III-m)
wherein A, B, M, R, L, n and r have the same meaning as described above.

Specific examples of the colored couplers represented by the general formulae (II) and (III) are illustrated below but the invention is not to be construed as being limited to these specific colored couplers only.

(1)

1-Hydroxy-4-{β-[4-(1-hydroxy-3,6-disulfo-8-acetamido-2-naphthylazo)phenoxy]ethoxy}-2-N-[γ-(2,4-di-tert-amylphenoxy)propyl]naphthamide·disodium salt (2)

1-Hydroxy-4-{β-[4-(1-hydroxy-3,6-disulfo-8-acetamido-2-naphthylazo)phenoxy]ethoxy}-2-N-(2'-chloro-5'-hexadecyloxycarbonyl)naphthanilide·disodium salt (3)

1-Hydroxy-4-{β-[4-(1-hydroxy-3,6-disulfo-8-acetamido-2-naphthylazo)phenoxy]ethoxy}-2-N-(2'-tetradecyloxy)naphthanilide·disodium salt (4)

1-Hydroxy-4-[4-(1-hydroxy-3,6-disulfo-8-acetamido-2-naphthylazo)benzyloxy]-2-N-[γ-(2,4-di-tert-amylphenoxy)propyl]naphthamide·disodium salt (5)

1-Hydroxy-4-{2-hydroxy-3-[4-(1-hydroxy-3,6-disulfo-8-acetamido-2-naphthylazo)phenoxy]propyloxy}-2-N-hexadecylnaphthamide·disodium salt (6)

1-Hydroxy-4-{γ-[4-(1-hydroxy-3,6-disulfo-8-acetamido-2-naphthylazo)phenoxy]propyloxy}-2-[2-chloro-5-(2,4-di-tert-amylphenoxy)acetamido]naphthanilide·disodium salt (7)

1-Hydroxy-4-{δ-[4-(1-hydroxy-3,6-disulfo-8-acetamido-2-naphthylazo)phenoxy]butyloxy}-2-[N-(γ-decyloxy)propyl]naphthamide·disodium salt (8)

1-Hydroxy-4-[β-{β-[4-(1-hydroxy-3,6-disulfo-8-acetamido-2-naphthylazo)phenoxy]ethoxy}ethoxy]-2-(4-tetradecyloxy)naphthanilide·disodium salt (9)

1-Hydroxy-4-{4-[4-(1-hydroxy-3,6-disulfo-8-acetamido-2-naphthylazo)phenoxy]benzyloxy}-2-N-(β-cyanoethyl)-N-hexadecylnaphthamide·disodium salt (10)

4-{β-[4-(1-Hydroxy-3,6-disulfo-8-acetamido-2-naphthylazo)phenoxy]ethoxy}-2-(2,4-di-tert-amylphenoxy)acetamidophenol·disodium salt (11)

2-Chloro-3-methyl-4-[4-(1-hydroxy-3,6-disulfo-8-acetamido-2-naphthylazo)phenoxy]-6-(2,4-di-tert-amylphenoxy)acetamidophenol·disodium salt (12)

2-(2,2,3,3,4,4,5,5-Octafluoropentanamido)-4-[4-(1-hydroxy-3,6-disulfo-8-acetamido-2-naphthylazo)-phenoxy]-5-tetradecanamidophenol.disodium salt (13)

2-[α-(3-Pentadecylphenoxy)isobutyramido]-4-{β-[4-(1-hydroxy-3,6-disulfo-8-acetamido-2-naphthylazo)-phenoxy]ethoxy}-5-butylmercaptophenol.disodium salt (14)

2-Chloro-3-methyl-4-[4-(4-sulfophenylazo)phenoxy]-6-(2,4-di-tert-amylphenoxy)acetamidophenol.sodium salt (15)

2-Hexadecanamido-4-[4-(1-hydroxy-3,6-disulfo-8-acetamido-2-naphthylazo)phenoxy]phenol disodium salt (16)

2-Chloro-3-methyl-4-{β-[4-(1-hydroxy-3,6-disulfo-8-acetamido-2-naphthylazo)phenoxy]ethoxy}-6-[α-(2,4-di-tertamylphenoxy)butyramido]phenol.disodium salt (17)

1-(2,4,6-Trichlorophenyl)-3-(2-chloro-5-tetradecanamidoanilino)-4-[4-(1-hydroxy-3,6-disulfo-8-acetamido-2-naphthylazo)- phenoxy]-2-pyrazolin -5-one.disodium salt (18)

α-[4-(1-Hydroxy-3,6-disulfo-8-acetamido-2-naphthylazo)phenoxy]-α-pioaloyl -2-chloro-5-[α-(2,4-di-tert-amylphenoxy)butyramido]acetoanilide.disodium salt (19)

α-Phenoxy-α-{4-[1-(4-sulfophenyl)-3-methyl-5-oxo-4-pyrazolylazo]phenoxy}-3-(2,4-di-tert-amylphenoxyacetamido)- acetophenone.sodium salt (20)

α-(2,4-Di-tert-amylbenzoyl)-α-{3-[4-(4-((N-ethyl-N-γ-sulfopropylamino)phenylimino)-2-benzoquinonylcarbamoyl]phenylthio}-acetonitrile.sodium salt (21)

1-(2,4,6-Trichlorophenyl)-3-(3-tetradecanamido- benzamido)-4-{4-[4-(4-dimethylaminophenylimino)-2-naphthoquinonylcarbonylamino]benzenesulfonamido}-2-pyrazoline-5-one (22)

1-Hydroxy-4-{γ-[4-(1-hydroxy-3,6-disulfo-8-benzamido-2-naphthylazo)phenoxy]butyloxy}-N-dodecyl-2-naphthamide.disodium salt (23)

α-{3-[1-Methyl-2,4-dioxo-5-(4-(2-benzothiazolylzao)-phenoxy)]hydantoinyl}-α-pivaloyl-2-chloro-5-[γ-(2,4-di-tert-amylphenoxy)butyramido]acetanilide (24)

α-[4-(1,2-Dihydroxy-3-sulfo-7-anthraquinonylcarbamoyl)-phenoxy]-α-benzyl-2-methoxy-5-tetradecyloxycarbonylacetanilide.sodium salt (25)

1-Hydroxy-4-{β-[4-(1-hydroxy -3,6-disulfo-8-acetamido-2-naphthylazo)naphthoxy]ethoxy}-N-[γ-(2,4-di-tert-amylphenoxy)propyl]-2-naphthamide.-disodium salt (26)

1-Hydroxy-4-{4-[4-(1-hydroxy-3,6-disulfo-8-amino-2-naphthylazo)phenoxy]benzyloxy}-N-n-hexadecyl-2naphthamide.disodium salt (27)

1-Hydroxy4-{β-[4-(2-hydroxy-3carboxy-1-naphthylazo)phenyl]ethoxy}-N-n-hexadecyl-2-naphthamide (28)

1-Hydroxy-4{γ-[4-(1-hydroxy-5-sulfo-8-acetamido-2-naphthylazo)phenoxy]propyloxy}-N-n-hexadecyl-2-npahthamide.sodium salt (29)

1-Hydroxy-4-{β-[4-(1-hydroxy-5-sulfo-8-methanesulfon amido2naphthylazo)phenoxy]ethoxy}-N-[γ-(2,4-di-tert-amylphenoxyl-propyl]-2-naphthamide.disodium salt (30)

1-Hydroxy-4-{β-[4-(1-hydroxy-3,6-disulfo-8-propionamido-2-naphthylazo)phenoxy]ethoxy}-N-n-dodecyl-2-naphthamide.disodium salt (31)

2-Chloro-3-methyl-4-[4-(1-hydroxy-3-sulfo-7-propionamido-2-naphthylazo)phenoxy]-6-(2,4-di-tert-amyl-phenoxyacetamido)-phenol.sodium salt

(32)

2-Chloro-3-methyl-4-{β-[4-(1-hydroxy-3-sulfo-7-propionamido-2-naphthylazo)phenoxy]ethoxy}-6-(2,4-di-tert-amyl-phenoxyacetamido)phenol.sodium salt (33)

2-Chloro-3-methyl-4-[4-(1-hydroxy-3-sulfo-6-dimethylamino-2-naphthylazo)phenoxy]-6-(2,4-di-tert-amyl-phenoxyacetamido)phenol.sodium salt (34)

1-Hydroxy-4-{β-[4-(2-hydroxy-disulfo-1-naphthylazo)-phenoxy]ethoxy}-N-[γ-(2,4-di-tert-amyl-phenoxy)propyl]-2-naphthamide.disodium salt (35)

2-Hexadecanamido-4-[4-(1-hydroxy-3,6-disulfo-8-propionamido-2-naphthylazo)phenoxy]-5-octanamido-phenol.disodium salt (36)

2-Heptafluorobutyramido-4-[4-(1-hydroxy-3,6-disulfo-8-acetamido-2-naphthylazo)phenoxy]-5-hexadecanamidophenol.disodium salt.

The synthesis of the non-diffusible colored cyan couplers used in this invention is shown specifically by referring to the following Synthesis Examples. Unless otherwise indicated herein, all parts, percents, ratios and the like are by weight.

Synthesis Example 1

Synthesis of 1-Hydroxy-4- β-[4-(1-hydroxy-3,6-disulfo-8-acetamido-2-naphthylazo)phenoxy]ethoxy -2-N-[γ-2,4-di-tert-amylphenoxy)propyl]naphthamide.-disodium salt (Coupler (1)):

Intermediate 1: 1-Hydroxy-4-ethoxy-2-naphthoic acid:

By refluxing an ethanol solution of 1,4-dihydroxy-2-naphthoic acid under heating and passing hydrogen chloride gas through the solution for 5 hours, 1-hydroxy-ethoxy-2-naphthoic acid having a melting point of 190–195° C was obtained.

Intermediate 2: 1-Hydroxy -4-ethoxy-N-[γ-(2,4-di-tert-amylphenoxy)propyl]-2-naphthamide:

A mixture of 23.2 g of Intermediate 1 prepared above, 18 g of thionyl chloride, and 100 ml of benzene was stirred for 3 hours at 40–45° C and after adding to the mixture a solution of 60 g of -(2,4-di-tert-amylphenoxy)-propylamine, 23 g of 1,4-diazabicyclo[2,2,2]octane, and 100 ml of benzene, the resultant mixture was stirred for 2 hours to provide the desired product. The solvent used for the recrystallization of the product was methanol. The melting point of the product was 130–131° C.

Intermediate 3:
1-Hydroxy-4-[β-(4-nitrophenoxy)ethoxy]-N-[γ-(2,4-di-tert-amylphenoxy)propyl]-2-naphthamide:

By heating a mixture of 5 g of Intermediate 2, 12 g of β-(4-nitrophenoxy)ethanol, and 0.3 g of methanesulfonic acid to 140–150° C for 3 hours under a reduced pressure, the desired product was obtained. The solvent used for the recrystallization of the product was acetonitrile. The melting point of the product was 166–168° C.

Intermediate 4:

1-Hydroxy-4-[β-(4-aminophenoxy)ethoxy]-N-[γ-(2,4-di-tert-amylphenoxy)propyl]-2-naphthamide:

By dispersing 6.4 g of Intermediate 3 in 64 ml of ethanol and then hydrogenating the intermediate in an autoclave using a palladium-carbon catalyst, the desired product was obtained. The solvent used for the recrystallization was ethanol. The melting point of the product was 147–149° C.

Coupler (1): In a mixed solvent of methanol and hydrochloric acid, 6.1 g of Intermediate 4 was converted into the diazonium salt thereof using sodium nitrite in a conventional manner and the diazonium salt was coupled with an aqueous methanol-sodium hydroxide solution of 3.6 g of 1-hydroxy-3,6-disulfo-8-acetamidonaphthalene disodium salt. The reaction mixture was acidified with hydrochloric acid and the precipitate thus formed was recovered by filtration, washed with water, dried, and washed with 300 ml of acetonitrile to provide the desired coupler having a melting point of higher than 300° C.

In addition, Couplers (2), (3), (4), (6), (7), (8), and (9) were produced in a similar manner to the synthesis of Coupler (1).

SYNTHESIS EXAMPLE 2

Synthesis of 1-Hydroxy-4-{2-hydroxy-3-[4-(1-hydroxy-3,6-disulfo-8-acetamido-2-naphthylazo)-phenoxy]propyloxy}-2-(N-hexadecyl)-naphthamide.-disodium salt (Coupler (5):

A mixture of 4.3 g of 1,4-dihydroxy-2-(N-hexadecyl)-naphthamide, 2.2 g of p-nitrophenyl glycidyl ether, and 0.85 g of benzyltrimethyl ammonium hydroxide (40% methanol solution) was refluxed in 50 ml of methyl isobutyl ketone for 5 hours under heating to provide 1-hydroxy-4-[2-hydroxy-3-(4-nitrophenoxy)-propyloxy]-2-(N-hexadecyl)naphthamide. Then, in the same manner as in the synthesis of Coupler 1 in Synthesis Example 1 above using the product thus obtained, Coupler (5) was produced.

SYNTHESIS EXAMPLE 3

Synthesis of 2-Hexadecanamido -4-[4-(1-hydroxy-3,6-disulfo-8-acetamido -2-naphthylazo)phenoxy]phenol.-disodium salt (Coupler (15)):

Intermediate:

4-(4-Nitrophenoxy)-2-hexadecanamido-anisole:

By reducing 4-ethoxycarbonyloxo-2-nitrophenol prepared as described in R. Robinson et al *Journal of the Chemical Society*; 129 392 (1926), 4-ethoxycarbonyloxy-2-aminoanisole was produced and then by reacting the product with hexadecanoyl chloride and hydrolyzing the product with an aqueous alkali solution (sodium hydroxide or potassium hydroxide), 4-hydroxy-2-hexadecanoylaminoanisole having a melting point of 198–200° C was obtained. The solvent used for the recrystallization was methanol. By reacting the product with p-nitrofluorobenzene in dimethylformamide in the presence of an alkali (sodium hydroxide or potassium hydroxide), the desired intermediate having a melting point of 150–151° C was obtained. The solvent used for the recrystallization was ethanol.

Coupler (15): A mixture of 5 g of the intermediate prepared in the above procedure and 5 g of aluminum bromide was refluxed under heating in anhydrous benzene for 16 hours and then by treating the product with dilute hydrochloric acid, 4-(4-nitrophenoxy)-2-hexadecanoylaminophenol having a melting point of 96–97° C was obtained. The solvent used for the recrystallization was methanol. Then, by following the same procedure as in the synthesis of Coupler (1) in Synthesis Example 1, the desired coupler was obtained.

The multilayer color photographic material of this invention can have, in addition to silver halide photographic emulsion layers, various auxiliary layers such as, for example, an antihalation layer, a light filter layer, a mixing prevention layer, an anti-color irradiation layer, a protective layer, etc.

In the multilayer color photographic materials of this invention, the colored coupling compound such as, for example, the colored couplers represented by the general formulae (II) and (III) can be incorporated in the silver ahlide photographic emulsion layers or the auxiliary layers.

In particular, when the colored coupler of the general formula (II) or (III) is incorporated in the silver halide photographic emulsion layer of the color photographic material, the colored coupler is usually incorporated in a red-sensitive silver halide emulsion layer together with a colorless cyanforming coupler and in this case it is particularly preferred in the combination of both couplers that the coupling speed of the colored coupler of the general formula (II) or (III) be higher than that of the colorless cyan coupler since in such a case an effective masking effect is obtained with a low mask density.

Furthermore, the colored coupler of the general formula (II) or (III) can be incorporated in the auxiliary layer which does not contain any silver halide disposed adjacent the red-sensitive silver halide emulsion layer. In this case, the oxidation product of a primary aromatic amino developing agent formed in the red-sensitive silver halide emulsion layer by the development of the red-sensitive emulsion layer diffuses partially into the auxiliary layer containing the colored coupler of the general formula (II) or (III), whereby the oxidation product exhibits a masking effect by coupling reaction with the coupler and at the time the formation of color mixing caused by the diffusion of the oxidation product into the other silver halide photographic emulsion layers can be prevented. Such effects are particularly marked when the coupling speed of the colored coupler of the general formula (II) or (III) is higher. Also, in this case, to further increase the color mixing prevention effect, a hydroquinone derivative can be used.

In the multilayer color photographic materials of this invention, various layer structures can be selected depending on the purpose of the color photographic materials. For example, a red-sensitive silver halide emulsion layer, a green-sensitive silver halide emulsion layer, and a blue-sensitive silver halide emulsion layer can be formed in this order on a support and further this order of the layers can be changed. Moreover, at least one of the red-sensitive silver halide emulsion layer, the green-sensitive silver halide emulsion layer, and the blue-sensitive silver halide emulsion can be divided into two or more layers and, in this case, two of more of the separate layers sensitive to the same wave length region can be disposed adjacent each other or can be separated by another silver halide emulsion layer sensitive to a different wave length region or another auxiliary layer.

When the red-sensitive silver halide emulsion layer and the green-sensitive silver halide emulsion layer of the multilayer color photographic material of this invention are in an order such that the red-sensitive silver halide emulsion layer is disposed nearer the support and, in this case, the colored cyan coupler of the general formula (II) or (III) having, in particular, an absorption in the green wave length region is incorporated in the auxiliary layer disposed between the red-sensitive silver halide emulsion layer and the green-sensitive silver halide emulsion layer, the sharpness of the color images is also improved by a so-called "unsharp masking effect" caused by an extension of the oxidized product of a primary aromatic amino developing agent at diffusion in addition to the masking effect and the color mixing prevention effect. Further the fading of the green dye image caused by the re-reflection of green light and also by the occurence of color mixing in the red-sensive silver halide emulsion layer by undesired heat in the green wave length region can be prevented since when the color photographic material is exposed, the green light which was not absorbed in the green-sensitive silver halide emulsion layer is absorbed in this auxiliary layer. In this case, it is particularly advantageous to place a color mixing prevention layer (i.e., a layer containing, e.g., a hydroquinone derivative) between the auxiliary layer and the green-sensitive emulsion layer since cyan coupling of the colored coupler-containing layer due to the oxidation product of a primary aromatic amino developing agent diffused from the green-sensitive silver halide emulsion layer at development can be prevented.

When the red-sensitive silver halide emulsion layer and the blue-sensitive silver halide emulsion layer of the multilayer color photographic material of this invention are in an order such that the red-sensitive silver halide emulsion layer is disposed nearer the support, the above effects are obtained by incorporating the colored cyan coupler of the general formula (II) or (III) having, in particular, an absorption in the blue wave length region in an auxiliary layer disposed between the red-sensitive silver halide emulsion layer and the green-sensitive silver halide emulsion layer.

The amount of the colored coupling compounds such as, for example, the colored cyan couplers of the general formula (II) and/or the general formula (II) used for the multilayer color photographic materials of this invention depends upon the purpose of the color photographic materials and the structure of the coupling compounds but is preferably about $10^{-6}$ to $10^{-3}$ mole/m$^2$, in particular $10^{-5}$ to $5 \times 10^{-4}$ mole/m$^2$.

Various methods can be employed to incorporate the colored coupling compounds such as the colored cyan couplers of the general formulae (II) and (III) in the coating layers constituting the color photographic material of this invention. Typical examples of these methods are described as follows.

(a) The colored coupling compound is first dissolved in an aqueous solution of an alkali such as sodium hydroxide, potassium hydroxide, lithium hydroxide, calcium hydroxide, magnesium hydroxide, sodium carbonate, potassium carbonate, ammonia, trimethylamine, etc., the aqueous solution of the colored coupling compound is added to a coating composition for the color photographic material, and, if necessary, the pH of the mixture is adjusted by adding an acid such as acetic acid, citric acid, tartaric acid, hydrochloric acid, sulfuric acid, etc.

(b) The colored coupling compound is dissolved in a water-miscible organic solvent such as methanol, ethanol, acetone, dimethylformamide, dimethyl sulfoxide, a mixture of these organic solvents, or a mixture of these organic solvents and water and then the solution of the coupling compounds is added to a coating composition of the color photographic material. In this case the alkali used in method (a) described above can be used.

(c) The colored coupling compound is dissolved in an organic solvent sparingly soluble in water, such as ethyl acetate, cyclohexanone, β-butylethoxyethyl acetate, dibutyl phthalate, tricresyl phosphate, etc., or a mixture of these organic solvents, the solution of the coupling compound is dispersed by emulsification in an aqueous medium, and then the emulsion is added to a coating composition for the color photographic material.

In these cases, an anionic surface active agent such as, for example, a sodium alkylbenzenesulfonate, sodium dioctylsulfosuccinate, sodium dodecylsulfate, a sodium alkylnaphthalenesulfonate, a Fischer type coupler, etc.; an amphoteric surface active agent such as, for example, N-tetradodecyl-N,N-dipolyethylene-α-betaine, etc.; or a nonionic surface active agent such as, for example, sorbitan monolaurate, etc., can be used as dispersion aid.

The coupler of this invention can be incorporated in a silver halide photographic emulsion layer or an auxiliary layer individually or together with a coupler conventionally known in the field of color photography. In this case, the coupler to be incorporated with the coupler of this invention can be added to the coating composition as a separate dispersion thereof or can be added thereto as a dispersion thereof with the coupler of this invention.

The colored coupling compound of this invention, such as, for example, the non-diffusible colored cyan coupler, etc., is preferably added as an aqueous alkali solution thereof while the conventional phenolic or naphtholic non-diffusible cyan coupler is added as oil droplets in a high-boiling organic solvent.

The multilayer color photographic materials of this invention can contain known colorforming couplers in addition to the colored coupling compound of this invention, such as, for example, the colored cyan couplers of the general formula (II) or (III). In particular, the color forming couplers represented by the following general formula (A), (B), (C), or (D) are useful:

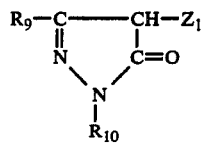

(A)

wherein R9 represents a primary, secondary, or tertiary alkyl group (e.g., a methyl group, a propyl group, an n-butyl group, a tert-butyl group, a hexyl group, a 2-hydroxyethyl group, a 2-phenylethyl group, a pentadecyl group, etc.), an aryl group (e.g., a phenyl group, 2,4- a di-tert-phenyl group, etc.), an alkoxy group (e.g., a methoxy group, a ethoxy group, a benzyloxy group, etc.), an aryloxy group (e.g., a phenoxy group, etc.), a heterocyclic group (e.g., a quinolinyl group, a pyridyl group, a benzofuranyl group, a oxazolyl group, etc.), an amino group (e.g., a methylamino group, a diethylamino group, a phenylamino group, a tolylamino group, a 4-(3-sulfobenzamino)-anilino group, a 2-chloro-5-acrylaminoanilino group, a 2-chloro-5-alkoxycarbonylanilino group, a 2-trifluoromethylphenylamino group, etc.), an acylamino group (e.g., an alkylcarbamido group such as an ethylcarbamido group, an arylcarboamido group, such as phenylcarbamido group etc., a heterocyclic carbamido group such as benzothiazolylcarboamido group, an alkyl sulfamido group such as a methylsulfamido group, etc., or an arylsulfamido group such as a phenylsulfamido group etc.), or a ureido group (e.g., an alkylureido group, an arylureido group, a heterocyclic ureido group, etc.); $R_{10}$ represents an aryl group (e.g., a naphthyl group, a phenyl group, a 2,4,6-trichlorophenyl group, a 2-chloro-4,6-dimethylphenyl group, a 2,6-dichloro-4-methoxyphenyl group, a 4-methylphenyl group, a 4-acylaminophenyl group, a 4-alkylaminophenyl group, a 4-trifluoromethylphenyl group, a 3,5-dibromophenyl group, etc.), a heterocyclic group (e.g., a benzofuranyl group, a benzothiazolyl group, a quinolinyl group, etc.), or an alkyl group (e.g., a methyl group, an ethyl group, a t-butyl group, a benzyl group, etc.); $X_1$ represents a hydrogen atom or a group which can be released at color development, such as, for example, a thiocyano group, an acyloxy group, an aryloxy group, an alkoxy group, an alkoxycarbonyloxy group, an aryloxycarbonyloxy group, a di-substituted amino group, an arylazo group, a heterocyclic azo group, etc., as described in U.S. Pat. Nos. 3,419,391; 3,252,924; 3,311,476; and 3,227,550, and Japanese Patent Application Nos. 41,869/1973 and 56,050/1973.

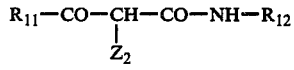

(B)

wherein $R_{11}$ represents a primary, secondary, or tertiary alkyl group (e.g., a tert-butyl group, a 1,1-dimethylpropyl group, a 1,1-dimethyl-1-methoxyphenoxymethyl group, etc.), an aryl group (e.g., a phenyl group, an alkylphenyl group such as a 2-methylphenyl group, a 3-octadecylphenyl group etc., an alkoxyphenyl group such as a 2-methoxyphenyl group, a 4-methoxyphenyl group etc., a halophenyl group, a 2-chloro-5-alkylcarbamidophenyl group, a 2-chloro-5-[α-(2,4-di-tert-aminophenoxy)butyramido]phenyl group, a 2-methoxy-5-alkylamidophenyl group, or a 2-chloro-5-sulfoamidophenyl group, etc.); $R_{12}$ represents a phenyl group (e.g., a 2-chlorophenyl group, a 2-halo-5-alkylamidophenyl group, a 2-chloro-5-[α-(2,4-di-tert-amylphenoxy)acetamido]phenyl group, a 2-chloro-5-(4-methylphenylsulfamido)phenyl group, a 2-methoxy-5-(2,4-di-tert-amylphenoxy)acetamidophenyl group, etc.); and $Z_2$ represents a hydrogen atom or a group which can be released at color development, such as, for example, a halogen atom, in particular, a fluorine atom, an acyloxy group, an aryloxy group, a heterocyclic carbonyloxy group, a sulfimido group, an alkylsulfoxy group, an arylsulfoxy group, a phthalimido group, a dioxoimdazolidinyl group, a dioxooxazolidinyl group, a dioxothiazolidinyl group, a dioxomorpholino group, etc., described in U.S. Pat. Nos. 3,227,550; 3,253,924; 3,277,155; 3,265,506; 3,408,194; and 3,415,652, French Pat. No. 1,411,384, British Pat. Nos. 944,490; 1,040,710; and 1,118,028, German Patent Application (OLS) Nos. 2,057,941; 2,163,812; 2,213,561; and 2,219,917, and Japanese Patent Application No. 54,456/1973.

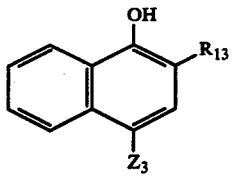
(C)

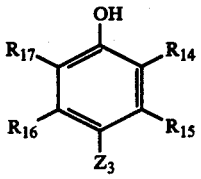
(D)

wherein $R_{13}$ represents a substituent usually used for cyan couplers, such as a carbamyl group (e.g., an alkylcarbamyl group such as a methylcarbamyl group, an arylcarbamyl group such as a phenylcarbamyl group etc., a heterocyclic carbamyl group such as a benzothiazolylcarbamyl group, etc.), a sulfamyl group (e.g., an alkylsulfamyl group, an arylsulfamyl group such as a phenylsulfamyl group, a heterocyclic sulfamyl group, etc.), an alkoxycarbonyl group, an aryloxycarbonyl group, etc.; $R_{14}$ represents an alkyl group, an aryl group, a heterocyclic group, an amino group, a carbamido group (e.g., an alkylcarbamido group, an arylcarbamido group a heterocyclic carbamido group, etc.), a sulfamido group, a sulfamyl group, or a carbamyl group; $R_{15}$; $R_{16}$; and $R_{17}$ each represents a group as defined for $R_{14}$ or further represents a halogen atom or an alkoxy group; and $Z_3$ represents a hydrogen atom or a group which can be released at color development, such as, for example, a halogen atom, a thiocyano group, a cycloimido group (e.g., maleimido group, succinimido group, 1,2-dicarboxyimido group, etc.), an arylazo group, or a heterocyclic azo group.

The couplers represented by the above general formulae (A), (B), (C), and (D) preferably contain a non-diffusible group, etc., i.e., a ballast group as described for the couplers of the general formulae (II) and (III).

Of the color forming couplers represented by the formulae (A), (B), (C) and (D) above, the couplers represented by the following formula (G) are particularly useful

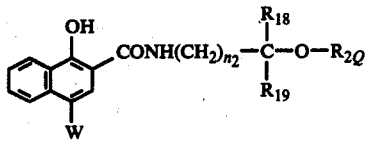
(E)

wherein $R_{18}$ and $R_{19}$ each represents a hydrogen atom or an alkyl group, $R_{20}$ represents a phenyl group, W represents a hydrogen atom, a halogen atom or a group releasable by coupling, and $n_2$ is an integer larger than 0.

Typical examples of the couplers used for the multilayer color photographic materials of this invention are shown below by way of illustration only.

Yellow Couplers

α-{3-[α-(2,4-Di-tert-amylphenoxy)butyramido]benzoyl}-2-methoxyacetanilide

α-Acetoxy-α-3-[γ-(2,4-di-tert-amylphenoxy)-butyramido]-benzoyl-2-methoxyacetanilide N-(4-Anisoylacetamidobenzenesulfonyl)-N-benzyl-N-toluidine α-(2,4-Dioxo-5,5-dimethyloxazolidine-3-yl)-α-pivaloyl-2-chloro-5-[α-(2,4-di-tert-amylphenoxy)-butyramido]acetanilide α-(4-Carboxyphenoxy)-α-pivaloyl-2-chloro-5-[α-(2,4-di-tert-amylphenoxy)butyramido]acetanilide α-(1-Benzyl-2,4-dioxohydantoin-3-yl)-α-pivaloyl-2-chloro-5-[α-(2,4-di-tert-amylphenoxy)-butyramido]acetanilide α-(4-Methoxybenzoyl)-α-(3,5-dioxomorpholino)-5-[α-(2,4-di-tert-amylphenoxy)butyramido]-2-chloroacetanilide

Magenta Couplers 1-(2,4,6-Trichlorophenyl)-3-[3-(2,4-di-tert-amylphenoxyacetamido)benzamido]-5-pyrazolone 1-(2,4,6-Trichlorophenyl)-3-[3-(2,4-di-tert-amylphenoxyacetamido)benzamido]-4-acetoxy-5-pyrazolone 1-(2,4,6-Trichlorophenyl)-3-tetradecanamido-4-(4-hydroxyphenylazo)-5-pyrazolone 1-(2,4,6-Trichlorophenyl)-3-[(2-chloro-5-tetradecarbamido)-anilino]-5-pyrazolone 1-(2,4,6-Trichlorophenyl)-3-[(2-chloro-5-tetradecyloxycarbonyl)anilino]-4-(1-naphthylazo)-5-pyrazolone 1-(2,4-Di-chloro-6-methoxyphenyl)-3-[(2-chloro-5-tetradecanamido)anilino]-4-benzyloxycarbonyloxy-5-pyrazolone 1-(2,4,6-Trichlorophenyl)-3-[3-(2,4-di-tert-amylphenoxyacetamido)benzamido]-4-piperidino-5-pyrazolone 1-(2,4,6-Trichlorophenyl)-3-{2-chloro-5-[α-(2,4-di-tert-amylphenoxy)butyramido]anilino}-4-N-phthalimido-5-pyrazolone 1-(2,4,6-Trichlorophenyl)-3-[(2-chloro-5-tetradecanamido)anilino]-4-(3-methyl-4-hydroxyphenylazo)-5-pyrazolone

Cyan Couplers

1-Hydroxy-N-[γ-(2,4-di-tert-amylphenoxy)propyl]-2-naphthamide

1-Hydroxy-4-[2-(2-hexadecyloxycarbonyl)-phenylazo]-N-(1-naphthyl)-2-naphthamide

1-Hydroxy-4-chloro-N-[α-(2,4-di-tert-amylphenoxy)-butyl]-2-naphthamide

5-Methyl-4,6-dichloro-2-[α-(3-n-pentadecylphenoxy)-butyramido]phenol

1-Hydroxy-4-[2-(ethoxycarbonyl)phenylazo]-N-(2-ethylhexyl)-2-naphthamide

The multilayer color photographic materials of this invention particularly preferably contain a so-called development inhibitor releasing coupler (i.e., a DIR coupler) as described in, e.g., U.S. Patent application Ser. No. 454,525 filed on Mar. 25, 1974 (German Patent Application (OLS) No. 2414006) and U.S. Pat. No. 3,227,554 in addition to the colored coupling compound of this invention, such as the colored cyan coupler of general formulae (II) or (III) and the above-described color forming coupler since in this case photographic materials having quite excellent granularity, color reproduction, and sharpness can be obtained. Furthermore, hydroquinones known as development inhibitor releasing hydroquinones (i.e., DIR hydroquinones) as described in U.S. Patent application Ser. No. 461,087 filed Apr. 15, 1974 (German Patent Application (OLS) No. 2417914) and U.S. Pat. No. 3,379,529 provide almost the same effect as the DIR coupler.

Particularly preferred DIR couplers are the couplers represented by the following general formula (F) although the DIR couplers used in this invention are not limited to these materials.

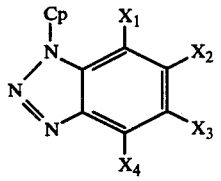

(F)

wherein $X_1$, $X_2$, $X_3$ and $X_4$ each represents a hydrogen atom or a photographically inert group (e.g., a halogen atom, an alkyl group, an aryl group, an acylamino group, a nitro group, a cyano group, an amino group, a heterocyclic group, etc.) and $C_p$ represents a coupler residue having a benzotriazole group bonded to the coupling position, more specifically, a coupler residue of an acylacetamide type yellow color forming coupler, a 5-pyrazolone type magenta color forming coupler, or a phenolic cyan color forming coupler.

Furthermore, the DIR hydroquinones represented by the following general formula (G) are particularly preferred in this invention although the DIR hydroquinones used in this invention are not limited to these compounds only.

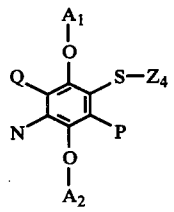

(G)

In the formula Q, N and P each represents a hydrogen atom, an alkyl group (e.g. having 1 to 18 carbon atoms such as methyl, ethyl, octyl, tridecyl and the like), an alkenyl group (e.g., having 2 to 18 carbon atoms such as allyl, octadecenyl and the like), a hydroxyl group, an alkoxy group (e.g., having 1 to 18 carbon atoms such as methoxy, ethoxy and the like), an amino group (e.g., an amino group or a substituted amino group having 1 to 30 total carbon atoms such as diethylamino, phenylamino, octadecylamino and the like), an alkylthio group (e.g., nonylthio, tridecylthio and the like), an aryl group (e.g., phenyl, tolyl, and the like), an arylthio group (e.g., phenylthio, tolythio and the like), a halogen atom, a heterocyclic group (e.g., tetrazolyl, thiazolyl, quinonyl and the like) or a $—SZ_4$ group (e.g., tetrazolylthio, thiadiazolylthio and the like), and Q and N can combine to form a carbocyclic ring group (e.g., a benzene ring group or a tetrahydrobenzene ring group). $A_1$ and $A_2$ each represents a hydrogen atom or alkaline splitable group selected from acyl groups and alkoxycarbonyl groups (e.g., having 1 to 8 carbon atoms such as acetyl, phenoxycarbonyl, methoxycarbonyl, etc.). $Z_4$ represents a heterocyclic residue which is photographically inactive in a combined state and which can be released at development, and particularly a heterocyclic aromatic group such as a tetrazolyl group (e.g., 1-phenyltetrazolyl, 1-alkoxyphenyl-tetrazolyl and the like), a triazolyl group (e.g. 1-phenyl, 3-n-amyl, 1,2,4-triazolyl and the like), a thiadiazolyl group (e.g., 5-methylthiothiadiazolyl, 5 propylthiadiazolyl and the like), an oxazolyl group (e.g. 4-methyloxazolyl, benzoxazolyl, β-naphthoxazolyl and the like), an oxadiazolyl group, a thiazolyl group or a pyrimidyl group.

Typical examples of the DIR couplers and DIR hydroquinones used preferably in this invention are specifically shown below:

DIR Couplers

1-[4-(2,4-Di-tert-amylphenoxyacetamido)phenyl]-3-methyl-4-(5- or 6-bromo-1-benzotriazolyl)-5-pyrazolone 1-{4-[α-(2,4-Di-tert-amylhenoxy)butyramido]-phenyl}-3-methyl-4-(5- or 6-bromo-1-benzotriazolyl)-5-pyrazolone 1-[4-(n)-Tetradecanamido)phenyl]-3-methyl-4-(5- or 6-bromo-1-benzotriazolyl)-5-pyrazolone 1-{4-[α-(2,4-Di-tert-amylphenoxy)butyramido]-phenyl}-3-phenyl-4-(1-benzotriazolyl)-5-pyrazolone α-Pivaloyl-α-(5- or 6-bromo-1-benzotriazolyl)-5-[α-(2,4-di-tert-amylphenoxy)butyramido]-2-chloroacetanilide 4-[α-(2,4-Di-tert-amylphenoxy)butyramido]-α-(5- or 6-bromo-1-benzotriazolyl)-4-aminoacetophenone 4-n-Dodecyl-α-(5- or 6-chloro-1-benzotriazolyl-)acetophenone, 4-n-Octadecyloxy-α-(5- or 6-nitro-1-indazolyl-)acetophenone, α-(4-Octadecyloxybenzoyl)-α-(5- or 5-bromo-1-benzotriazolyl)-2-methoxy-acetoanilide α-(4-Octadecyloxybenzoyl)-α-(5- or 6-oct anamido-1-benzotriazolyl)-2-methoxyacetoanilide α-(4-Octadecyloxybenzoyl)-α-[5-(3-methyl-2-benzothiazolinideneamino-1-benzotriazolyl]-2-ethoxyacetoanilide 1-(2,4,6-Trichlorophenyl)-3-[(2-chloro-5-tetradecanamido)anilino]-4-(5- or 6-acetamido-1-benzotriazolyl)-5-pyrazolone 1-{4-[α-(2,4-Di-tert-amylphenoxy)butyramido]-phenyl}-3-pyrrolidino-4-(1-indazolyl)-5-pyrazolone 1-[4-(3-n-Pentadecylphenoxyacetamido)phenyl]-3-pyrolidino-4-(5- or 6-methyl-1-benzotriazolyl)-5-pyrazolone 1-(4-Acetamidophenyl)-3-(2-methoxy-5-tetradecyloxycarbonylanilino)-4-(5- or 6-methyl-1-benzotriazolyl)-5-pyrazolone 1-(4-Acetamidophenyl)-3-(2-methoxy-5-tetradecyloxycarbonylanilino)-4-(5- or 6-bromo-1-benzotriazolyl)-5-pyrazolone 1-[4-(2,4-Di-tert-amylphenoxyacetamido)phenyl]-3-ethoxy-4-(5- or 6-methyl-1-benzotriazolyl)-5-pyrazolone 1-Benzyl-3-(2-chloro-5-tetradecanamidoanilino)-4-(5- or 6-bromo-1-benzotriazolyl)-5-pyrazolone 1-Benzyl-3-(2-chloro-5-tetradecanamidoanilino)-4-(5- or 6-methyl-1-benzotriazolyl)-5-pyrazolone 1-Benzyl-3-(4-octadecyloxyanilino)-4-(5- or 6-bromo-1-benzotriazolyl)-5-pyrazolone 1-Benzyl-3-(2-methyl-4-tetradecyloxyanilino)-4-(5- or 6-bromo-1-benzotriazolyl)-5-pyrazolone 1-Benzyl-3-(2-chloro-5-tetradecanamidoanilino)-4-(1-benzimidazolyl)-5-pyrazolone α-Benzoyl-α-(5- or 6-bromo-1-benzotriazolyl)-2-methoxy-5-hexadecyloxycarbonylacetanilide α-Benzoyl-α-(5- or 6-methylbenzotriazolyl)-2-methoxy-5-hexadecyloxycarbonylacetanilide α-(4-Octadecyloxybenzoyl)-α-(1-benzotriazolyl)-2-methoxyacetanilide α-(4-Octadecyloxybenzoyl)-α-(5- or 6-bromo-1-benzotriazolyl)-2-methoxyacetaniline α-(4-Octadecyloxybenzoyl)-α-(5- or 6-methyl-1-benzotriazolyl)-2-methoxyacetanilide α-(4-Octadecyloxybenzoyl)-α-(1-benzimidazolyl)-2-methoxyacetanilide α-(4-Methoxybenzoyl)-α-(5- or 6-bromo-1-benzotriazolyl)-2-octadecyloxyacetanilide α-(4-Methoxybenzoyl)-α-(5- or 6-acetamido-1-benzotriazolyl)-2-octadecyloxyacetanilide α-(4-Octadecyloxybenzoyl)-α-(5- or 6-bromobenzotriazolyl)-2,5-di-methoxyacetanilide α-(3,4,5-Trimethoxybenzoyl)-α-(5- or 6-bromobenzotriazolyl)-2-methoxy-5-tetradecyloxycarbonylacetanilide α-(2-Methoxybenzoyl)-α-(5- or 6-nitrobenzotriazolyl)-2-methoxy-5-[α-(2,4-di-tert-amylphenoxy)-butyramido]acetanilide α-Pivaloyl-α-(1-phenyltetrazolylthio)-5-[α-(2,4-di-tert-amylphenoxy)propionamido]-2-chloroacetanilide α-(4-Octadecyloxybenzoyl)-α-(1-phenyltetrazolylthio)-2-methoxyacetanilide α-Benzoyl-α-(1-phenyltetrazolylthio)-2-methoxy-5-hexadecyloxycarbonylacetoanilide 1-{4-[α-(2,4-Di-tert-amylphenoxy)butyramido]-phenyl}-3-dibutylamino-4-(1-phenyltetrazolylthio)-5-pyrazolone 1-{4-[α-(3-Pentadecylphenoxy)propionamido]-phenyl}-3-diethylamino-4-(benzthiazolylthio)-5-pyrazolone 1-{4-α-[α-(2,4-Di-tert-amylphenoxy)butyramido]-phenyl}-3-dibenzylamino-4-(1-phenyltetrazolylthio)-5-pyrazolone 1-{4-[α-(2,4-Di-tert-amylphenoxy)propionamido]-phenyl}-3-pyrrolidino-4-(1-phenyltetrazolylthio)-5-pyrazolone 1-{4-[(3-Pentadecylphenoxy)acetamido]phenyl}-3-ethoxy-4-(1-phenyl-tetrazolylthio)-5-pyrazolone 1-{4-[α-(2,4-Di-tert-amylphenoxy)butyramido]-phenyl}-3-(4-methoxy-anilino)-4-(1-(1-phenyltetrazolylthio)-5-pyrazolone 1-{4-[α-(2,4-Di-tert-amylphenoxy)butyramido]-phenyl}-3-(2,4-dimethyl-anilino)-4-(1-phenyltetrazolylthio)-5-pyrazolone 1-[4-(2,4-Di-tert-amylphenoxyacetamido)phenyl]-3-(2,4-dimethylanilino)-4-(1-phenyltetrazolylthio)-5-pyrazolone 1-Benzyl-3-(2-chloro-5-dodecanamidoanilino)-4-(1-phenyltetrazolylthio)-5-pyrazolone 1-(2,4,6-Trichlorophenyl)-3-(2-chloro-4-tetradecanamidoanilino)-4-(1-phenyltetrazolylthio)-5-pyrazolone 1-Hydroxy-4-(1-phenyltetrazolylthio)-N-[γ-(2,4-di-tert-amyl-phenoxy)propyl]-2-naphthamide 1-Hydroxy-4-(1-phenyltetrazolylthio)-(2-chloro-5-hexadecyloxycarbonyl)-2-naphthamide 1-Hydroxy-4-(1-phenyltetrazolylthio)-[2-methoxy-5-(2,4-di-tert-amylphenoxy)acetamido]-2-naphthanilide 2-[α-(2,4-Di-tert-amylphenoxy)butyramido]-4-(1-phenyltetrazolylthio)-5-methyl-6-chlorophenol.

DIR Hydroquinones:

2-n-Dodecylthio-5-(1-phenyltetrazolylthio)hydroquinone 2-n-Octadecylthio-5-(1-phenyltetrazolylthio)hydroquinone 2-n-Hexadecylthio-5-(1-phenyltetrazolylthio)hydroquinone 2-(1'-Phenyltetrazolylthio)-3-phenylthio-6-(1'', 1'', 3'', 3''-tetramethylbutyl)hydroquinone 2-n-Hexadecylthio-5-(1'-phenyltetrazolylthio)-6-phenylthiohydroquinone 2-n-Octadecylthio-5-(1-phenyltetrazolylthio)-6-phenylthiohydroquinone 2-n-Pentadecylthio-5-(1-phenyltetrazolylthio)hydroquinone 2-[2',5'-Dihydroxy-6'-(1''-phenyltetrazol-5''-ylthio)-3'-octadecylphenylthio]benzoic acid methyl ester 2-[2',5'-Dihydroxy-6'-(1''-phenyltetrazol-5''-ylthio)-3'-hexadecylthiophenylthio]benzoic acid amyl ester 2-(2'-Methylthio-1',3',4'-thiadiazol-5'-ylthio)-6-n-pentadecylhydroquinone 2-(3'-n-Pentyl-4'-phenyl-1',2',4'-triazol-5'-ylthio)-5-hexadecylhydroquinone 2-(6'-Methyl-1',3',3a',7'-tetraazainden-4'-ylthio)-6-(1'',1'',3'',3''-tetramethylbutyl)hydroquinone The photographic light-sensitive materials of the present invention can be conventional photgraphic light-sensitive materials containing silver halide as a light-sensitive substance.

The silver halide photographic emulsion which can be used in the present invention comprises a light-sensitive silver halide such as silver chloride, silver bromide, silver chlorobromide, silver iodobromide, silver chloroiodide, silver chloroiodobromide, and the like, dispersed in a hydrophilic polymer, and can be prepared by various known methods. For example, a single jet method, a double jet method, a controlled double jet method, and the like, can be employed. A mixture of two or more silver halide emulsions which are prepared separately can also be used.

The silver halide grains can have a homogeneous crystal structure, layered structure in which the interior differs from the outer layer of the grain, or the so-called conversion-type silver halide grains as described in British Pat. No. 635,841 and U.S. Pat. Nos. 2,592,250 and 3,622,318. Silver halide grains which form latent image predominantly on the surface of the grains or predominantly in the interior of the grains can also be used. These photographic emulsions are described, for example, in C. E. K. Mees & T. H. James, *The Theory of the Photographic Process*, 3rd Ed. MacMillan, New York (1966); and P. Grafkides, *Chimie Photographique*, Paul Montel, Paris, (1957), and can be prepared by known methods such as an ammonia method, a neutral method and an acid method.

After the formation of the silver halide grains, the emulsion can be washed with water in order to remove the by-produced water-soluble salts (for example, potassium nitrate where silver bromide is formed from silver nitrate and potassium bromide, and then ripened by heating in the presence of a chemical sensitizer such as sodium thiosulfate, N,N,N'-trimethylthiourea, a thiocyanate complex of monovalent gold, a thiosulfate complex of monovalent gold, stannous chloride, hexamethylenetetramine, and the like, to increase the sensitivity without coarsening the grains. General methods for these chemical sensitization techniques are described in the above-mentioned references.

Specific examples of suitable chemical sensitizers include, for example, gold compounds such as chloroaurates and gold trichloride as described in U.S. Pat. Nos. 2,399,083, 2,540,085, 2,597,856 and 2,597,915; salts of a noble metal, such as platinum, palladium, iridium, rhodium and ruthenium, as described in U.S. Pat. Nos. 2,448,060, 2,540,086, 2,566,245, 2,566,263 and 2,598,079; sulfur compounds capable of forming silver sulfide by reacting with a silver salt, such as those described in U.S. Pat. Nos. 1,574,944, 2,410,689, 3,189,458 and 3,501,313; stannous salts, amines, and other reducing compounds such as those described in U.S. Pat. Nos. 2,487,850, 2,518,698, 2,521,925, 2,521,926, 2,694,637, 2,983,610 and 3,201,254, and the like.

Various kinds of conventional stabilizers or anti-fogging agents can be added to the photographic emulsions used in the present invention in order to prevent a reduction in the sensitivity or a formation of fog. A wide variety of such compounds are known such as heterocyclic compounds, mercury-containing compounds, mercapto compounds or metal salts, including 4-hydroxy-6-methyl-1,3,3a,7-tetraazaindene, 3-methylbenzothiazole and 1-phenyl-5-mercaptotetrazole. Examples of these compounds which can be used are described, for example, in U.S. Pat. Nos. 1,758,576, 2,110,178, 2,131,038, 2,173,628, 2,697,040, 2,304,962, 2,324,123, 2,394,198, 2,444,605-8, 2,566,245, 2,694,716, 2,697,099, 2,708,162, 2,728,663-5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339; and British Pat. Nos. 893,428, 403,789, 1,173,609 and 1,200,188.

The photographic emulsions can be spectrally sensitized or supersensitized using a cyanine dye such as cyanine, merocyanine, carbocyanine or styryl dyes, either individually or in combination. Spectral sensitization techniques are well known, and are described, for example, in U.S. Pat. Nos. 2,493,748, 2,519,001, 2,977,229, 3,480,434, 3,672,897, 3,703,377, 2,688,545, 2,912,329, 3,397,060, 3,615,635 and 3,628,964; British Pat. Nos. 1,195,302, 1,242,588 and 1,293,862; German Patent Application OLS Nos. 2,030,326 and 2,121,780; Japanese Patent Publication Nos. 4,936/1968, 14,030/1969 and 10,773/1968; U.S. Pat. Nos. 3,511,664, 3,522,052, 3,527,641, 3,615,613, 3,615,632, 3,617,295, 3,635,271 and 3,694,217; and British Pat. Nos. 1,137,580 and 1,216,203, and the like. The spectral sensitizers can be chosen as desired depending on the spectral range, sensitivity, and the like depending on the purpose and uses of the photographic materials to be sensitized.

Examples of hydrophilic colloids which can be used as a binder for the silver halide grains include, for example, gelatin, colloidal albumin, casein, a cellulose derivative such as carboxymethylcellulose and hydroxyethylcellulose, a polysaccharide derivative such as agar-agar, sodium alginate and a starch derivative, a synthetic hydrophilic colloid such as polyvinyl alchol, poly-N-vinyl pyrrolidone, polyacrylic acid copolymers and polyacrylamide, or the derivatives or partially hydrolyzed products thereof. If desired, compatible mixtures of these colloids can also be employed. Of these colloids, gelatin is most commonly used. It can be replaced partially or completely by a synthetic polymer, by a so-called gelatin derivative such as those prepared by reacting or modifying the amino, imino, hydroxy or carboxy groups contained, as functional groups, in the gelatin molecule with a compound containing a group capable of reacting with the above-described groups, or a graft gelatin such as those prepared by grafting another polymer chain on the gelatin molecule.

Examples of suitable compounds which can be used for the preparation of the above-described gelatin derivatives include isocyanates, acid chlorides and acid anhydrides such as those described in U.S. Pat. No. 2,614,928; acid anhydrides such as those described in U.S. Pat. No. 3,118,766; bromoacetic acids such as those described in Japanese Patent Publication No. 5,514/1964; phenyl glycidyl ethers such as those described in Japanese Patent Publication No. 26,845/1967; vinylsulfones such as those described in U.S. Pat. No. 3,132,945; N-allylvinylsulfonamides such as those described in British Patent No. 861,414; maleinimides such as those described in U.S. Pat. No. 3,186,846; acrylonitriles such as those described in U.S. Pat. No. 2,594,293; polyalkylene oxides such as those described in U.S. Patent No. 3,312,553; epoxy compounds such as those described in Japanese Patent Publication No. 26,845/1967; esters such as those described in U.S. Pat. No. 2,763,639; and alkane sultones such as those described in Bristish Pat. No. 1,033,189.

A wide variety of polymers or copolymers can be employed as polymers to be grafted to gelatin including those obtained from the so-called vinyl monomers such as acrylic acid, methacrylic acid or derivatives thereof, e.g., the esters, amides and nitriles thereof; or styrene. Other examples of suitable polymers are described in U.S. Pat. Nos. 2,763,625, 2,831,767 and 2,956,884; *Polymer Letters*, Vol. 5, page 595 (1967); *Phot. Sci. Eng.*, Vol. 9, page 148 (1965); and *J. Polymer Sci.*, Part A-1, Vol. 9, page 3,199 (1971). Hydrophilic polymers or copolymers having a certain degree of compatibility with gelatin such as those prepared from acrylic acid, methacrylic acid, acrylamide, methacrylamide, hydroxyalkylacrylates, hydroxyalkylmethacrylates, and the like are particularly desirable.

The hydrophilic layers which constitute the photographic light-sensitive materials of the present invention can be hardened using conventional methods. Examples of suitable hardeners include, for example, an aldehyde type compound such as formaldehyde and glutaraldehyde; a ketone compound such as diacetyl and cyclopentadione; a reactive halogen-containing compound such as bis(2-chloroethylurea), 2-hydroxy-4,6-dichloro-1,3,5-triazine and those described in U.S. Pat. Nos. 3,288,775 and 2,732,303; and British Pat. Nos. 974,723 and 1,167,207; a reactive olefin containing compound such as divinyl sulfone, 5-acetyl-1,3-diacryloylhexahydro-1,3,5-triazine and those described in U.S.

Pat. Nos. 3,635,718 and 3,232,763; and British Pat. No. 994,869; an N-methylol compound such as N-hydroxymethylphthalimide and those described in U.S. Pat. Nos. 2,732,316 and 2,586,168; an isocyanate compound such as those described in U.S. Pat. No. 3,103,473; and aziridine compound such as those described in U.S. Pat. Nos. 3,017,280 and 2,983,611; an acid derivative such as those described in U.S. Pat. Nos. 2,725,294 and 2,725,295; a carbodiimide compound such as those described in U.S. Pat. No. 3,100,704; an epoxy compound such as those described in U.S. Pat. No. 3,091,537; and isooxazole compound such as those described in U.S. Pat. Nos. 3,321,313 and 3,543,292; a halocarboxyaldehyde such as mucochloric acid; a dioxane derivative such as dihydroxydioxane and dichlorodioxane; and an inorganic hardener such as chrome alum and zirconium sulfate. Instead of the above compounds, precursors of hardeners such as the alkali metal bisulfite-aldehyde adducts, methylol derivatives of hydantoin, primary fatty nitroalcohols and the like can also be used.

The photographic layers which constitute the photographic light-sensitive materials of the present invention can be applied to a substantially planar material which does not undergo any servere dimensional change during processing, for example, a rigid support such as glass, metal or ceramics, or a flexible support as desired. Representative flexible supports include those generally employed for photographic materials, such as a cellulose nitrate film, a cellulose acetate film, a cellulose acetate butyrate film, a cellulose acetate propionate film, a polystyrene film, a polyethylene terephthalate film, a polycarbonate film, a laminate of these polymers, a thin glass film and paper. A baryta coated paper, a paper which is coated or laminated with an α-olefin polymer, particularly those obtained from a monomer having from 2 to 10 carbon atoms, such as polyethylene, polypropylene and ethylene-butene copolymers, and a synthetic resin film in which the adhesiveness to other polymers and the printing properties are improved by roughening the surfaces thereof, such as is described in Japanese Patent Publication No. 19,068/1972 can also be used to advantage as a support.

These supports can be transparent or opaque, depending on the purposes of the photographic materials. Colored transparent supports which contain a dye or pigment can also be used. Such colored supports have been utilized in X-ray films, and are described in *J. SMPTE*, Vol. 67, page 296 (1958).

Examples of opaque supports include opaque films produced by incorporating into a transparent film a dye or a pigment such as titanium oxide and zinc oxide, or surface-treated plastic films such as those described in Japanese Patent Publication No. 19,068/1972, as well as intrinsically opaque materials such as paper. Highly light-shielding papers and synthetic resin films containing, for example, carbon black or dyes can also be used. When the adhesion between a support and a photographic layer is unsatisfactory, a subbing layer adhesive to both the support and the photographic layer can be provided on the support. The surfaces of the support can also be pre-treated by a corona discharge, a UV radiation treatment, a flame treatment and the like in order to further improve the adhesion.

The photographic layers can be applied to a support using various conventional coating methods, including, for example, a dip coating method, an air-knife coating method, a curtain coating method and an extrusion coating method using the hopper described in U.S. Pat. No. 2,681,294. If desired, two or more layers can be coated simultaneously using the methods as described in U.S. Pat. Nos. 2,761,791, 3,508,947, 2,941,898 and 3,526,528. A suitable coating amount of the silver halide can range from about $5 \times 10^{-5}$ to about $1 \times 10^{-1}$ mole/m$^2$.

The color couplers generally can be used in an amount of about $10^{-6}$ to about $10^{-3}$ mol/m$^2$ in each layer.

The photographic light-sensitive materials of the present invention can include in addition to the silver halide emulsion layers, substantially light-insensitive layers including conventional layers such as a surface protective layer, a filter layer, an intermediate layer, an antihalation layer, a barrier layer, an anti-curling layer, a backing layer, and the like.

The color photographic materials of this invention can also contain a hydroquinone derivative such as an alkylhydroquinone as a color mixing prevention agent. Such a hydroquinone derivative is advantageous by incorporated in the interlayers. In particular, in the case of incorporating the colored cyan coupler of the general formula (II) or (III) in a layer which does not contain silver halide disposed adjacent a red-sensitive silver halide emulsion layer, it is particularly advantageous to form an interlayer containing the hydroquinone derivative adjacent the layer containing the colored cyan coupler since in this case the diffusion of the oxidation product of a primary aromatic amino developing agent diffused from photosensitive silver halide emulsion layers other than the red-sensitive silver halide emulsion layer can be prevented and also the occurence of desired coloring in silver halide photosensitive silver halide emulsion layers other than the red-sensitive silver halide emulsion layer by the colored cyan coupler of the general formula (II) or (III) can be prevented.

The color photographic materials of this invention can further contain a fading prevention agent for color images and examples of these agents are the phenol or hydroquinone derivatives and the precursors thereof as described in Belgian Pat. No. 777,487, German Pat. No. 1,547,684, German Patent Application (OLS) No. 2,146,668, U.S. Pat. Nos. 2,336,327; 2,728,659; 2,835,579; and 3,700,453, and German Patent Application (OLS) No. 2432041.

Any light source can be employed for exposing the photographic light-sensitive materials.

The aromatic primary amino developing agents which can be used in the method of forming photographic images of the present invention include those which have a primary amino group on the aromatic ring and which develop exposed silver halide, and precursors of these compounds.

Suitable color developing agents include o-aminophenols, p-aminophenols, N,N-disubstituted-o-phenylenediamines, and in particular, N,N-disubstituted-p-phenylenediamines. Specific examples of these color developing agents are 4-amino-3-dimethylamino-N,N-diethylaniline, 4-amino-3-ethoxy-N,N-diethylaniline, 4-amino-3,5-dimethyl-N,N-diethylaniline, 4-amino-3-methyl-N, ethyl-N-(β-hydroxyethyl)aniline, 4-amino-3-methyl-N,N-diethylaniline, 4-amino-3-methyl-N-ethyl-N-(β-methanesulfonamidoethyl)aniline, 4-amino-3-(β-methanesulfonamidoethyl)-N,N-diethylaniline, 4-amino-N-ethyl-N-(β-hydroxyethyl)aniline, 4-amino-N,N-diethylaniline, 4-amino-N-ethyl-N-ω-sulfobutylaniline, 4-amino-3-methyl-N-ethyl-N-(β-methoxyethyl)aniline, 4-amino-3-methyl-N-ethyl-N-(β-ethoxyethyl)aniline, and the like.

These aromatic primary amino developing agents are described, for example, in U.S. Pat. Nos. 2,193,015 and 2,592,364; Japanese Patent Application OPI No. 64,933/1973; and L. F. A. Mason, *Photographic Processing Chemistry,* pages 226 - 229, Focal Press, London (1966). They can be used, if desired, together with 3-pyrazolidones.

The color developer solution can contain various additives, if desired. Typical examples of these additives include alkali agents (for example, alkali metal or ammonium hydroxides, carbonates or phosphates and the like; pH-adjusting agents or buffers (for example, weak acids such as acetic acid and boric acid; weak bases; salts thereof; and the like)); developing accelerators (for example, various pyridinium compounds or cationic compounds such as those described in U.S. Pat. Nos. 2,648,604 and 3,671,247; potassium nitrate; sodium nitrate; condensation products of polyethylene glycol and their derivatives, such as those described in U.S. Pat. Nos. 2,533,990, 2,577,127 and 2,950,970; nonionic compounds such as polythioethers represented by those described in British Pat. Nos. 1,020,033 and 1,020,032; polymeric compounds having sulfite ester groups such as those described in U.S. Pat. No. 3,068,097; organic amines such as pyridine and ethanolamine; benzyl alcohol; hydrazines and the like); anti-fogging agents (for example, alkali metal bromides; alkali metal iodides; nitrobenzimidazoles such as those described in U.S. Pat. Nos. 2,496,940 and 2,656,271; mercaptobenzimidazole; 5-methylbenzotriazole; 1-phenyl-5-mercaptotetrazole; compounds for use in rapid processing solutions such as those described in U.S. Pat. Nos. 3,113,864, 3,342,596, 3,295,976, 3,615,522 and 3,597,199; thiosulfonyl compounds such as those described in British Pat. No. 972,211; phenazine-N-oxides such as those described in Japanese Patent Publication No. 41,675/1971; those described in *Kagaku Shashin Binran* (*Handbook of Photographic Science*), Vol. II, pages 29 - 47 and the like); stain or sludge preventing agents such as those described in U.S. Pat. Nos. 3,161,513 and 3,161,514; and British Pat. Nos. 1,030,442, 1,144,481 and 1,251,558; interlayer-effect accelerators as disclosed in U.S. Pat. No. 3,536,487; preservatives (for example, sulfites, bisulfites, hydroxyamine hydrochloride, formsulfite, alkanolamine-sulfite adducts, etc.) and the like.

In the present invention, color developers conventionally used for developing negative color photographic materials, negative or positive cine color films, color papers, and instant color photographic materials can be employed. For example, the color developing processes described in Japanese Patent Publication No. 35,749/1970, Japanese Patent Application Nos. 67,798/1969; 13,313/1971; and 19,516/1971, and German Patent Application (OLS) 2,238,051 and further in H. Gordon; *The British Journal or Photography,* page 558 (Nov. 15, 1954); ibid., page 440, (Sept. 9, 1955); ibid., page 2 (Jan. 6, 1956); S. Horwitz, ibid., page 212 (Apr. 22, 1960); ibid., page 396 (May 7, 1965); and J. Meech, ibid., page 182 (Apr. 3, 1959) can be used in this invention.

After color development, the color photographic materials are subjected to a bleaching. The bleaching can be simultaneously carried out together with the fixing. A bleaching bath can be converted to a blixing bath by adding a fixing agent, if desired. Many compounds can be used as a bleaching agent. Of these bleaching agents, ferricyanides; bichromates; water-soluble cobalt (III) salts, water-soluble copper (II) salts; water-soluble quinones; nitrosophenol; compounds of a polyvalent metal such as iron (III); cobalt (III); copper (II), etc., especially, complex salts of such a polyvalent cation, and an organic acid, for example, an aminopolycarboxylic acid such as ethylenediaminetetraacetic acid, nitrilotriacetic acid, iminodiacetic acid, N-hydroxyethylethylenediaminetriacetic acid acid, etc., malonic acid, tartaric acid, malic acid, diglycolic acid and dithioglycolic acid, and 2,6-dipicolinic acid; peracids such as alkylperacids, persulfates, permanganates and peroxides; hypochlorites; chlorine; bromine; and the like can be suitably used, individually or in combination. To the bleaching solution, bleaching accelerators such as those described in U.S. Pat. Nos. 3,042,520 and 3,241,966; and Japanese Patent Publication Nos. 8,506/1970 and 8,836/1970 and various other additives can be employed.

The color cyan couplers of this invention can also be used for low-silver photographic materials in which the amount of silver halide in the silver halide emulsion layers is from about 0.5 to about 0.01 of that in the silver halide emulsion layers of conventional photographic materials. In these low-silver type color photographic materials, satisfactory color images can be obtained using a development process in which after subjecting the developed silver formed by the color development to halogenation bleaching, the color photographic material is again color developed to increase the amount of dyes formed as described in U.S. Pat. No. 2,623,822 and 2,814,565 or an image forming process in which the amount of formed dyes is increased by utilizing a color intensification process using a peroxide or a cobalt complex salt as described in U.S. Pat. Nos. 3,674,490 and 3,761,265, German Patent Application (OLS) Nos. 2,357,694; 2,044,833; 2,056,359; 2,056,360; and 2,226,770, and Japanese Patent Application (OPI) Nos. 9728/1973 and 9729/1973.

The following non-limiting examples are given to illustrate the present invention.

EXAMPLE 1

Multi-layer color photographic Film A was prepared by coating a transparent cellulose triacetate film with the following layers 1 to 8 as illustrated in FIG. 1 of the accompanying drawings.

First layer: Antihalation layer:

A mixture of 1 kg of a 5% aqueous gelatin solution containing black colloidal silver and 1 g of Hardening Agent (1) shown below was coated on the film at a dry thickness of 1 micron.

Second layer: Interlayer:

A solution of 50 g of 2,5-di-tert-octylhydroquinone in a mixture of 100 ml of tricresyl phosphate and 200 ml of ethyl acetate was dispersed by emulsification in 1 kg of an aqueous gelatin solution with the addition of sodium di(2-ethylhexyl)sulfosuccinate using a high-speed stirrer, 250 g of the Emulsion I thus prepared was mixed with 1 kg of a 10% gelatin aqueous solution, and, after adding thereto 1 g of Hardening Agent (1), the resultant mixture was coated on the antihalation layer at a dry thickness of 1 micron.

Third layer: Red-sensitive silver halide emulsion layer:

A silver halide emulsion (amount of silver: 0.6 mole; iodide content: 7 mole%; mean grain size: 0.6 microns) was spectrally sensitized by adding thereto $4 \times 10^{-5}$ mole of Sensitizing Dye I and $1 \times 10^{-5}$ mole of Sensitizing Dye II per kilogram of the emulsion. Then, 70 g of Coupler I, 5 g of Coupler II, and 6 g of Coupler III were dissolved in a mixture of 50 ml of tricresyl phosphate and 100 ml of ethyl acetate and Emulsion II was prepared from the solution in the same manner as in the case of preparing Emulsion I 450 g of Emulsion II was added to 1 kg of the spectrally sensitized silver halide emulsion prepared above. Thereafter, after adding to the mixture 90 ml of a 5% aqueous alkali solution (containing 0.1 N NaOH) of Coupler (1) of this invention, 30 ml of a 2% aqueous citric acid solution, and further 0.7 g of Hardening Agent (1), the resultant mixture was coated at a dry thickness of 4.5 microns.

Fourth layer: Interlayer:

Same as the second layer.

Fifth layer: Green-sensitive silver halide emulsion layer:

A silver iodobromide emulsion having the same composition as that used for forming the third layer was spectrally sensitized using $2 \times 10^{-4}$ mole of Sensitizing Dye III and $6 \times 10^{-5}$ of Sensitizing Dye IV per kilogram of the emulsion. Then, 80 g of Coupler IV, 15 g of Coupler V, and 5 g of Coupler VI were dissolved in a mixture of 100 ml of tricresyl phosphate and 200 ml of ethyl acetate. Emulsion III was prepared from the solution in the same manner as in the case of preparing Emulsion I, 600 g of Emulsion III was added to 1 kg of the spectrally sensitized silver halide emulsion, and after adding thereto 0.9 g of Hardening Agent (1), the resultant mixture was coated at a dry thickness of 4 microns.

Seventh layer: Blue-sensitive silver halide emulsion layer:

Emulsion IV was prepared in the same manner as in the case of preparing Emulsion I from the solution of 100 g of Coupler VII in a mixture of 100 ml of dibutyl phthalate and 200 ml of ethyl acetate and 500 g of Emulsion IV thus prepared was added to 1 kg of a silver iodobromide emulsion (not spectrally sensitized) having the same composition as that used for forming the third layer. After adding further to the mixture 1 g of Hardening Agent (1), the resultant mixture was coated at a dry thickness of 3 microns.

Eighth layer: Protective layer:

A mixture of 1 kg of a 10% gelatin aqueous solution and 1 g of Hardening Agent (1) was coated at a dry thickness of 1 micron.

The materials used in preparing color photographic Film A were as follows:

Hardening Agent (1): 2,6-Di-chloro-4-hydroxy-s-triazine salt. (2% aqueous solution)

Coupler I; 1-Hydroxy-N-α-(2,4-di-tert-amylphenoxy)propyl]-2-naphthamide.

Coupler II: 1-Hydroxy-4-(4-ethoxycarbonylphenylazo)-N-dodecyl-2-naphthamide.

Coupler III: α-(4-Stearyloxybenzoyl)-α-[2- or 4-(N-methyl-benzothiazolyl-2-amino)benzotriazolyl]-2-methoxyacetanilide.

Coupler IV: 1-(2,4,6-Trichlorophenyl)-3-{-3[α-(2,4-di-tert-amylphenoxy)butyramido]benzoylamino}-5-pyrazolone.

Coupler V: 1-(2,4,6-Trichlorophenyl)-3-(2-chloro-5-tetradecanoylaminoanilino)-4-(3-methyl-5-hydroxyphenylazo)-5-pyrazolone.

Coupler VI: 1-Benzyl-3-(2-chloro-5-tetradecylaminoanilino)-4-(2- or 4-octanamido-1-benzotriazolyl)-5-pyrazolone.

Coupler VII: α-Pivaloyl-α-(N-benzylhydantoinyl)-2-chloro-5-[α-(2,4-di-tert-amylphenoxy)-butyramido]acetanilide.

Sensitizing Dye I: Anhydro-5,5'-dichloro-3,3'-disulfopropyl-9-ethylthiacarbocyanine hydroxide pyridinium salt.

Sensitizing Dye II: Anhydro-9-ethyl-3,3'-di(3-sulfopropyl)-4,5,4',5'-dibenzothiacarbocyanine hydroxide ethylamine salt.

Sensitizing Dye III: Anhydro-9'-ethyl-5,5'-dichloro-3,3'-disulfopropyloxacarbocyanine sodium salt.

Sensitizing Dye IV: Anhydro-5,6,5',6'-tetrachloro-1,1'-diethyl-3,3'-disulfopropoxyethylimidazolocarbocyanine hydroxide sodium salt.

A negative type color photographic film was prepared from each of the films A, B, and C thus prepared and after exposing in a still camera, the photographic film was processed using the following development process (1) at 38°C.

| | | |
|---|---|---|
| 1. | Color Development | 3 min. 15 sec. |
| 2. | Bleach | 6 min. 30 sec. |
| 3. | Wash | 3 min. 15 sec. |
| 4. | Fix | 6 min. 30 sec. |
| 5. | Wash | 3 min. 15 sec. |
| 6. | Stabiliazation | 3 min. 15 sec. |

The compositions of the processing solutions used for the above processes were as follows:

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methylanilino Sulfate | 4.5 g |
| Water to make | 1 liter. |
| Bleach Solution: | |
| Ammonium Bromide | 160.0 g |
| Ammonia (28% aq. soln.) | 25.0 ml |
| Sodium Ethylenediamine-tetraacetate Iron Salt | 130.0 g |
| Glacial Acetic Acid | 14.0 ml |
| Water to make | 1 liter. |
| Fix Solution: | |
| Sodium Tetrapolyphosphate | 2.0 g |
| Sodium Sulfite | 4.0 g |
| Ammonium Thiosulfate (70 % aq. soln.) | 175.0 ml |
| Sodium Bisulfite | 4.6 g |
| Water to make | 1 liter. |
| Stabilization Solution: | |
| Formaldehyde (40% aq. soln.) | 8.0 ml |
| Water to make | 1 liter. |

The results showed that the color negative obtained from Film A included in the color photographic materials of this invention was markedly superior to the color negative obtained from comparison Film C in sharpness and color purity. Also, it was confirmed that the color negative obtained from Film B had a large amount of fog in the red-sensitive silver halide emulsion layer as compared with Film A of this invention and was inferior to Films A and C in granularity. The above results demonstrate that the color negative obtained from Film A had quite excellent sharpness, granularity, and color purity.

EXAMPLE 2

Figure 2:
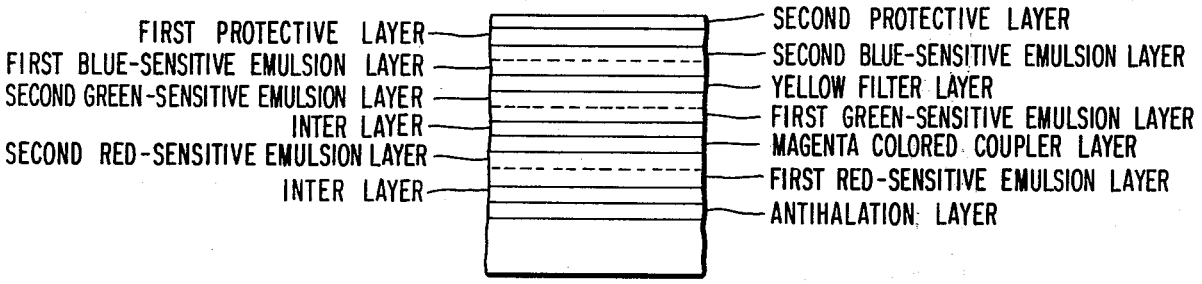

Multi-layer color photographic material having the layer structure as shown in FIG. 2 of the accompanying drawings was prepared in the same manner as in the case of Example 1. The composition of each coating layer was as follows:

First Layer: Antihalation layer:

Same as the first layer of Film A in Example 1.

Second layer: Interlayer:

To a mixture of 250 g of an emulsion having the same composition as the Emulsion I used for forming the second layer of Film A in Example 1 and 1 kg of a 10% gelatin aqueous solution were added 30 ml of a 5% aqueous alkali solution (containing 0.1 N NaOH) of Coupler (1) of this invention, 10 ml of a 2% aqueous solution of citric acid, and further 1 g of Hardening Agent (1), and then the resultant mixture was coated on the antihalation layer at a dry thickness of 1 micron.

Third layer: First red-sensitive silver halide emulsion layer (dry thickness of 2 microns):

A silver iodobromide emulsion (amount of silver: 0.05 mole%; content of iodide of silver halide grains: 7 mole%; mean grain size of silver halide grains: 0.4 micron; and content of gelatin: 6.2%) containing the following components was coated at a coverage of 1.4 g/m$^2$ of silver.

| | | |
|---|---|---|
| Sensitizing Dye I: | $5 \times 10^{-5}$ | mole per mole of silver |
| Sensitizing Dye II: | $1.2 \times 10^{-5}$ | " |
| Coupler I: | 0.09 mole | " |
| Coupler II: | 0.02 mole | " |
| Coupler III: | 0.01 mole | " |
| Hardening Agent (1): | 20 mg/m$^2$ | |

Fourth layer: Second red-sensitive silver halide emulsion layer (dry thickness of 1.5 microns):

A silver iodobromide emulsion (amount of silver: 0.05 mole%; iodide content of silver halide grains: 8 mole%; mean grain size of silver halide grains: 0.7 micron; content of gelatin: 6%) containing the following components was coated at a coverage of 1.0 g/m$^2$ of silver.

| | |
|---|---|
| Sensitizing Dye I: | $3 \times 10^{-5}$ mole per mole of silver |
| Sensitizing Dye II: | $1.2 \times 10^{-5}$ mole per mole of silver |
| Coupler I: | 0.05 mole per mole of silver |
| Coupler II: | 0.03 mole per mole of silver |
| Coupler III: | 0.01 mole per mole of silver |
| Hardening Agent (1): | 15 mg/m$^2$ |

Fifth layer: Magenta colored coupler layer:

This layer was formed in the same manner as in the case of forming the second layer except that 30 ml of a 5% aqueous alkali solution of Coupler (1) was changed to 70 ml of the same Coupler (1) solution and 10 ml of a 2% aqueous solution of citric acid was changed to 27 ml of the same citric acid solution. The dry thickness was 1.2 microns.

Sixth layer: Interlayer:

Same as the second layer of Film A in Example 1.

Seventh layer: First green-sensitive silver halide emulsion layer (dry thickness of 2.4 microns):

A silver iodobromide emulsion having the same composition as that of the silver halide emulsion used for forming the third layer and containing the following components was coated at a coverage of 1.4 g/m.$^2$ of silver.

| | | |
|---|---|---|
| Sensitizing Dye III: | $3 \times 10^{-5}$ mole | per mole of silver |
| Sensitizing Dye IV: | $1 \times 10^{-5}$ mole | " |
| Coupler IV: | 0.05 mole | " |
| Coupler V: | 0.01 mole | " |
| Coupler VI: | 0.005 mole | " |
| DIR Hydroquinone I: | 0.004 mole | " |
| Hardening Agent (1): | 25 mg/m$^2$ | |

Eighth layer: Second green-sensitive silver halide emulsion layer (dry thickness of 1.8 microns):

A silver iodobromide emulsion having the same composition as that of the silver halide emulsion used for forming the fourth layer and containing the following components was coated at a coverage of 2.5 g/m$^2$ of silver.

| | | |
|---|---|---|
| Sensitizing Dye III: | $2.4 \times 10^{-5}$ mole | per mole of silver |
| Sensitizing Dye IV: | $0.8 \times 10^{-5}$ mole | " |
| Coupler IV: | 0.005 mole | " |
| Coupler V: | 0.015 mole | " |
| Coupler VI: | 0.0006 mole | " |
| Hardening Agent (1): | 20 mg/m$^2$ | |

Ninth layer: Yellow filter layer:

Same as the sixth layer of Film A in Example 1.

Tenth layer: First blue-sensitive silver halide emulsion layer (dry thickness of 2 microns):

A silver iodobromide emulsion (amount of silver: 0.048 mole%; iodide content of silver halide grains: 7 mole%; mean grain size of silver halide grains: 0.5 micron; and gelatin content: 6%) containing the following components was coated at a coverage of 1.3 g/m$^2$ of silver.

| | |
|---|---|
| Coupler VII: | 0.25 mole per mole of silver |
| Hardening Agent (1): | 20 mg/m$^2$ |

Eleventh layer: Second blue-sensitive silver halide emulsion layer (dry thickness of 1.3 microns):

A silver iodobromide emulsion (amount of silver: 0.052 mole%; iodide content of silver halide grains: 6 mole%; mean grain size of silver halide grains: 0.7 micron; and gelatin content: 6%) containing the following components was coated at a coverage of 1.2 g/m$^2$ of silver.

| | |
|---|---|
| Coupler VII: | 0.06 mole per mole of silver |
| Hardening Agent (1): | 8 mg/m$^2$ |

Twelfth layer: First protective layer (dry thickness of 1 microns):

A silver iodobromide emulsion (amount of silver: 0.06 mole% mean grain size of silver halide grains: 0.05 micron, and gelatin content: 6%) containing 7 mg/m$^2$ of Hardening Agent (1) was coated at a coverage of 0.4 g/m$^2$ of silver.

Thirteenth layer: Second protective layer:

Same as the eighth layer of Film A in Example 1.

Of the materials used for preparing Film D, the couplers, sensitizing dyes, and hardening agent were same as those used for forming Film A and the other material was as follows:

DIR Hydroquinone (I): 2-n-Hexadecylthio-5-(1'-phenyltetrazol-5'-ylthio)-6-phenylthiohydroquinone.

A negative type color photographic film was prepared from Film D as in the case of Films A to C in Example 1, exposed, and processed in the same manner as in Example 1. The results showed that the color negative obtained from Film D was far superior to that of Film A in sharpness, granularity, and color purity.

When Coupler (2), (3), (11), or (12) of this invention was substituted for Coupler (1) in Films A and D, almost the same results were obtained.

While the invention has been described in detail and with reference to specific embodiments thereof, it will be apparent to one skilled in the art that various changes and modifications can be made therein without departing from the spirit and scope thereof.

What is claimed is:

1. A multi-layer color photographic material comprising a support having thereon at least a blue-sensitive silver halide emulsion layer containing a yellow dye-forming coupler, a green-sensitive silver halide emulsion layer containing a magenta dye-forming coupler, and a red-sensitive silver halide emulsion layer containing a cyan dye-forming coupler, said red-sensitive layer or a gelatin interlayer adjacent said red-sensitive layer containing a non-diffusible colored cyan coupler of the formula

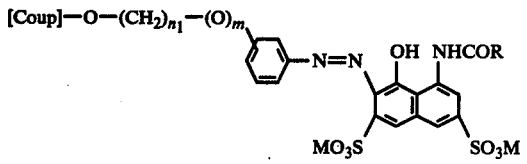

wherein Coup represents a 1-naphtholic cyan coupler residue substituted at the coupling position or a phenolic cyan coupler residue substituted at the coupling position, M represents a hydrogen atom or a monovalent cation, R represents an alkyl group, a phenol group or a naphthol group; $n_1$ is an integer of from 1 to 4; m is 0 or 1; and said cyan coupler releases on coupling reaction with the oxidation product of a primary aromatic amino developing agent, a diffusible dye capable of being leached from the photographic layer during the development process.

* * * * *